US009753424B2

(12) United States Patent
Kawana

(10) Patent No.: US 9,753,424 B2
(45) Date of Patent: Sep. 5, 2017

(54) MANAGEMENT SYSTEM, MANAGEMENT DEVICE, IMAGE FORMING DEVICE, MANAGEMENT SYSTEM CONTROL METHOD, AND STORAGE MEDIUM

(71) Applicant: CANON KABUSHIKI KAISHA, Tokyo (JP)

(72) Inventor: Yoshimasa Kawana, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/808,346

(22) Filed: Jul. 24, 2015

(65) Prior Publication Data

US 2015/0331378 A1 Nov. 19, 2015

Related U.S. Application Data

(63) Continuation of application No. 13/937,710, filed on Jul. 9, 2013, now Pat. No. 9,116,492.

(30) Foreign Application Priority Data

Jul. 19, 2012 (JP) ..... 2012-160296

(51) Int. Cl.
*G03G 15/00* (2006.01)

(52) U.S. Cl.
CPC ..... *G03G 15/5075* (2013.01); *G03G 15/5079* (2013.01); *G03G 15/55* (2013.01);
(Continued)

(58) Field of Classification Search
CPC .. G03G 15/55; G03G 15/553; G03G 15/5075; G03G 2215/00109; G03G 15/5079; G03G 15/556
See application file for complete search history.

(56) References Cited

U.S. PATENT DOCUMENTS 5,565,973 A 10/1996 Fujishiro et al.
5,995,774 A 11/1999 Applegate et al.
(Continued)

FOREIGN PATENT DOCUMENTS

JP 2002-197182 A 7/2002
JP 2008-250087 A 10/2008
JP 2012-22277 A 2/2012

OTHER PUBLICATIONS

Japanese Office Action dated May 24, 2016, in counterpart JP application No. 2012-160296 (6 pages).

*Primary Examiner* — Ryan Walsh
(74) *Attorney, Agent, or Firm* — Fitzpatrick, Cella, Harper & Scinto

(57) ABSTRACT

An image forming device provided in a management system manages remaining amount information of consumable contained in a loaded consumable container, detects identification information of a new consumable container to be loaded upon replacing the consumable container, and transmits a replacement notification including identification information, counter information indicating the operation status of the image forming device upon replacement, and remaining amount information of consumable contained in the previously loaded consumable container which has been removed by the replacement to a management device. The management device receives a replacement notification, associates identification information of a consumable container, counter information relating to the replacement of the consumable container, and the remaining amount information with each other based on the replacement notification, and stores the same as management information.

17 Claims, 21 Drawing Sheets

(52) U.S. Cl.
CPC ..... *G03G 15/553* (2013.01); *G03G 15/556* (2013.01); *G03G 2215/00109* (2013.01)

(56) References Cited

U.S. PATENT DOCUMENTS

| | | | | |
|---|---|---|---|---|
| 7,986,888 | B2 | 7/2011 | Hibino | |
| 2002/0077979 | A1 | 6/2002 | Nagata | |
| 2004/0207865 | A1 | 10/2004 | Wachter et al. | |
| 2008/0240745 | A1* | 10/2008 | Hibino ..... | G03G 15/553 399/24 |
| 2012/0014701 | A1 | 1/2012 | Tokuno et al. | |

* cited by examiner

FIG. 9

Toner management table

| Delivered bottle identifier | Device identifier | Bottle identifier | Toner bottle replaced date/time | Counter at the start of use | Counter at the end of use | Actual usage counter | Bottle remaining amount state upon removal |
|---|---|---|---|---|---|---|---|
| TNR01-4598 | DVC09485 | TNR01-4598 | 2011/05/17 13:56 | 3000 | 6000 | 3000 | Premature removal |
| TNR02-6885 | DVC11523 | TNR02-6885 | 2011/06/05 11:54 | 18000 | 25000 | 7000 | Premature removal |
| TNR01-4598 | DVC11523 | TNR01-4598 | 2011/09/13 16:32 | 25000 | 34000 | 9000 | Empty |
| TNR05-9908 | DVC09485 | TNR05-9908 | 2011/10/01 09:22 | 6000 | 18000 | 12000 | Empty |
| TNR04-2021 | DVC09485 | TNR04-2021 | 2011/10/19 11:32 | 18000 | 26000 | 8000 | Premature removal |
| TNR03-4423 | DVC11523 | TNR03-4423 | 2012/01/23 10:43 | 34000 | | | |
| TNR06-9976 | DVC09485 | TNR06-9976 | 2012/03/09 10:55 | 26000 | | | |
| TNR09-1121 | | | | | | | |
| TNR10-8857 | | | | | | | |

FIG. 16A

Alarm reception history

| Number | Alarm | Bottle identifier | Toner bottle replaced date/time | Counter value upon alarm transmission | Bottle remaining amount state upon removal |
|---|---|---|---|---|---|
| 1 | Toner bottle loaded | TNR01-6652 | 2011/05/17 13:56 | 1000 | N/A |
| 2 | Toner bottle loaded | TNR02-1254 | 2011/06/05 11:54 | 0 | N/A |
| 3 | Toner bottle removed | TNR02-1254 | 2011/09/13 16:32 | 6000 | Premature removal |
| 4 | Toner bottle removed | TNR01-6652 | 2011/10/01 09:22 | 8000 | Empty |
| 5 | Toner bottle loaded | TNR02-1254 | 2011/09/13 16:38 | 8000 | N/A |
| 6 | Toner bottle loaded | TNR03-8989 | 2012/10/01 09:25 | 6000 | N/A |
| 7 | Toner bottle removed | TNR02-1254 | 2012/02/09 10:55 | 12000 | Empty |
| 8 | Toner bottle removed | TNR03-8989 | 2012/03/12 15:34 | 14000 | Empty |
| 9 | Toner bottle loaded | TNR04-7745 | 2012/02/09 10:59 | 12000 | N/A |

FIG. 16B

Toner management table

| Delivered bottle ID | Alarm-received bottle identifier | Counter value at the start of use | Counter value at the end of use | Actual usage counter value | Bottle remaining amount state upon removal |
|---|---|---|---|---|---|
| TNR01-6652 | TNR01-6652 | 1000 | 8000 | 7000 | Empty |
| TNR03-8989 | TNR03-8989 | 6000 | 14000 | 8000 | Empty |
| TNR04-7745 | TNR04-7745 | 12000 | | | |
| TNR02-1254 | TNR02-1254 | 0 | 6000 | 6000 | Premature removal |
| TNR02-1254 | TNR02-1254 | 8000 | 12000 | 4000 | Empty |
| TNR05-6854 | | | | | |
| TNR06-7796 | | | | | |

FIG. 20

[Toner/Ink stock history] - Windows Internet Explorer

Toner/Ink stock history

Personnel

Toner/Ink stock storage location administrator
Stock storage location information

| Stock storage location | Toner/Ink model number | Toner/Ink mercury code | Product name | The number of initial stocks | The number of maximum stocks | The number of stocks to be reported |
|---|---|---|---|---|---|---|
| Location 1 | Cartridge K | 3845A | iR3250 (Printer), iR3250 (Scanner) | 5 | 5 | 5 |

The number of unused toner bottles in toner stocks that have been delivered to customer is X or greater.

| Category (Process code) | Product name | Device ID | Date/Time | Quantity | Total number of stocks | Total number of counters |
|---|---|---|---|---|---|---|
| Toner bottle replacement notification | sR XXXX | EAQ00016 | 2009-07-30 13:00 | 3 | 8 | 82242 |
| Toner bottle replacement notification | sR XXXX | EAQ00016 | 2009-07-17 14:00 | -1 | 5 | 82047 |
| Toner bottle replacement notification | sR YYYY | EAQ00016 | 2009-07-10 13:00 | -1 | 6 | 78218 |
| Toner bottle replacement notification | sR ZZZZ | MPQ00016 | 2009-06-27 14:00 | -1 | 7 | 54321 |
| Replenishment | | | 2009-06-20 13:00 | 3 | 8 | |
| Toner bottle replacement notification | sR XXXX | ABC00016 | 2009-06-17 14:00 | -1 | 5 | 45632 |
| Adjustment | | | 2009-06-10 13:00 | 1 | 6 | |
| Initial settings | | | | 5 | 5 | |

Input toner bottle ID

MANAGEMENT SYSTEM, MANAGEMENT DEVICE, IMAGE FORMING DEVICE, MANAGEMENT SYSTEM CONTROL METHOD, AND STORAGE MEDIUM

The present application is a continuation of U.S. application Ser. No. 13/937,710, filed on Jul. 9, 2013, which claims priority to JP 2012-160296, filed Jul. 19, 2012, the entire disclosure of each of which is incorporated by reference herein.

BACKGROUND OF THE INVENTION

Field of the Invention

The present invention relates to a management system, a management device, an image forming device, a management system control method, and a storage medium.

Description of the Related Art

There has been proposed a management system that manages consumables by monitoring the remaining amount of toner loaded in an image forming device. When the remaining amount of toner becomes low since a new toner bottle has been loaded in the image forming device, the management system provides a notification indicating the necessity of the replacement of the toner bottle. Japanese Patent Laid-Open No. 2012-22277 discloses a management system that receives toner remaining amount information from an image forming device, determines that the toner bottle delivery time is reached when the received remaining amount of toner is less than a predetermined value, and provides a toner bottle delivery request based on the determination. In addition, the management system disclosed in Japanese Patent Laid-Open No. 2012-22277 determines the optimum timing for providing a toner bottle replacement notification using the remaining amount of a toner bottle loaded in an image forming device, the number of copies printed, and a coverage.

The management system disclosed in Japanese Patent Laid-Open No. 2012-22277 does not consider the case where a new toner bottle may be prematurely replaced before completion of the use of the toner bottle since the loading thereof in an image forming device. However, in practice, a user may replace a toner bottle even when the remaining amount of toner is still present in the toner bottle. The reason for this is because, in order to make an image forming device operate continuously during the night in a company or the like, a user who uses the image forming device may replace the previously loaded bottle with a new toner bottle before the user gets home from the company. If a toner bottle loaded in the image forming device is replaced before the toner stored in the toner bottle is completely used, a conventional toner management system cannot perform appropriate management.

Also, a maintenance service contract for an image forming device is present between the sales company of the image forming device and its customer. For example, in the contract, there is a clause that a sales company receives a maintenance service fee corresponding to the number of copies printed instead all the payment of toner used by the image forming device of interest shall be borne by the sales company. If a toner bottle in which the remaining amount of toner is present is discarded by a customer under the contract without complete use of the toner, the replacement of toner bottles may significantly exceed the assumption made by the sales company. In such a case, the sales company has no choice but to increase a service price for a maintenance contract itself in order to compensate an increase in toner payment due to the replacement of toner bottles exceeding the assumption. Such a cost increase may be disadvantageous for both the customer and the sales company. Thus, it is preferable that consumable such as a toner bottle is replaced after being completely used.

SUMMARY OF THE INVENTION

The present invention provides a mechanism that is capable of managing whether or not consumable is prematurely replaced by holding remaining amount information of consumable in association with a consumable container upon replacement of the consumable container.

According to an aspect of the present invention, a management system is provided that includes an image forming device that replaceably loads a consumable container; and a management device that communicates with the image forming device via a network. The image forming device includes a management unit configured to manage remaining amount information of consumable contained in the loaded consumable container; a detection unit configured to detect identification information of a new consumable container to be loaded on the image forming device upon replacement of the consumable container; and a transmission unit configured to transmit a replacement notification including the detected identification information, counter information indicating the operation status of the image forming device upon replacement, and remaining amount information of consumable contained in the previously loaded consumable container which has been removed by the replacement to the management device. The management device includes a reception unit configured to receive the replacement notification; and a storage unit configured to store identification information of the consumable container, counter information relating to the replacement of the consumable container, and the remaining amount information as management information based on the received replacement notification.

According to the management system of the present invention, whether or not consumable is prematurely replaced can be managed upon replacement of a consumable container. Consequently, consumable can be suppressed from being prematurely replaced.

Further features of the present invention will become apparent from the following description of exemplary embodiments with reference to the attached drawings.

BRIEF DESCRIPTION OF THE DRAWINGS

FIG. 9 illustrates an example of a management table of a toner bottle managed by a management device.

FIG. 16A illustrates an example of an alarm history.

FIG. 16B illustrates an example of a toner bottle management table.

FIG. 20 illustrates an example of another notification which is notified to a user by a management device.

DESCRIPTION OF THE EMBODIMENTS

<Example of Configuration of the Device Management System of the Present Embodiment>

Figure 1:
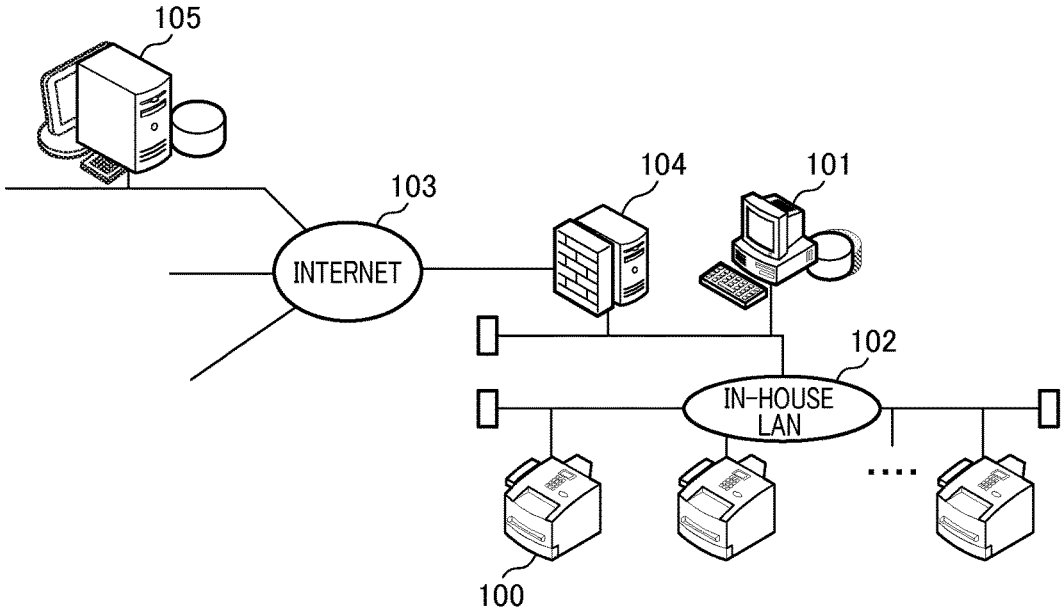
FIG. 1 is a diagram illustrating an exemplary configuration of a management system including an image forming device and a management device.

FIG. 1 is a diagram illustrating an exemplary configuration of a management system according to one embodiment of the present invention. The management system includes a copier, a remote monitoring device, and management device. The devices are communicably connected with each other via a network. As shown in FIG. 1, an image forming device 100 indicates an MFP (Multi Function Printer) or an SFP (Single Function Printer) which is connected to the in-house LAN of a customer. This is a device having a print function, a copy function, or the like and is referred to as an "image forming device" in the present embodiment. A site monitoring device 101 monitors a plurality of the image forming devices 100. An in-house LAN 102 is connected to a plurality of the image forming devices 100 and the site monitoring device 101. The site monitoring device 101 acquires monitor information of an image forming device from the image forming device via the in-house LAN 102.

Internet 103 provides an external network to the in-house LAN 102. The in-house LAN 102 is provided with a firewall 104 which is a connection point to the Internet 103. The firewall 104 prevents unauthorized network access from external to the in-house LAN 102. Devices that are connected through an in-house LAN can communicate with an external server via the firewall 104.

A management server 105 is a management device that monitors a plurality of image forming devices installed at a customer. The site monitoring device 101 transmits monitor information of an image forming device acquired via the in-house LAN 102 to the management server 105 on Internet. The management server 105 manages an image forming device based on monitor information received from the site monitoring device 101. A countless number of networks for different customers, where each network is similar to that of the in-house LAN 102 of the customer, are connected to the Internet 103, and the management server 105 can manage a plurality of image forming devices for a plurality of customers.

Although the site monitoring device 101 is shown in the drawing as a typical computer, the site monitoring device 101 indicates a device for executing a monitoring program. Thus, the monitoring program can be installed on not only PCs but also dedicated hardware or image forming devices. Thus, there is no limitation on the form of the site monitoring device. For example, there is an image forming device 100 that can cause the control unit provided therein to execute a monitoring program without the need for the site monitoring device 101. Since a monitoring program is installed on such an image forming device, the image forming device generates monitor information to be transmitted by the site monitoring device 101 by itself and directly transmits the monitor information to the management server 105.

The site monitoring device 101 centrally collects monitor information from image forming devices that are present on the in-house LAN when a countless number of image forming devices is present on the in-house LAN 102 of the customer. Then, the site monitoring device 101 transmits the collected monitor information to the management server 105, resulting in an increase in maintenance efficiency. The technique described herein is effective in both cases where management of image forming devices is performed via the site monitoring device 101 and where management of image forming devices is performed through transmission of monitor information by image forming devices themselves and thus is not intended to limit the connection format.

In the present embodiment, it is assumed that the image forming device 100 has a self-monitoring function. Monitor information that is transmitted from the image forming device 100 to the management server 105 includes various types of counter information indicating the usage state of an image forming device, firmware information, and information such as error information or alarm information indicating the image processing state of an image forming device. The management server 105 receives these types of monitor information and provides services such as displaying an accounting counter report, notifying trouble event such as an error or an alarm, calculating the extent of wearing of parts of an image forming device, managing toner quantity in stock, or the like to the sales company. In particular, the management server 105 manages whether or not toner is used efficiently and appropriately by receiving event information regarding toner bottle replacement from among monitor information transmitted from the image forming device 100.

<Example of Configuration of the Control Unit in the Image Forming Device of the Present Embodiment>

Figure 2:
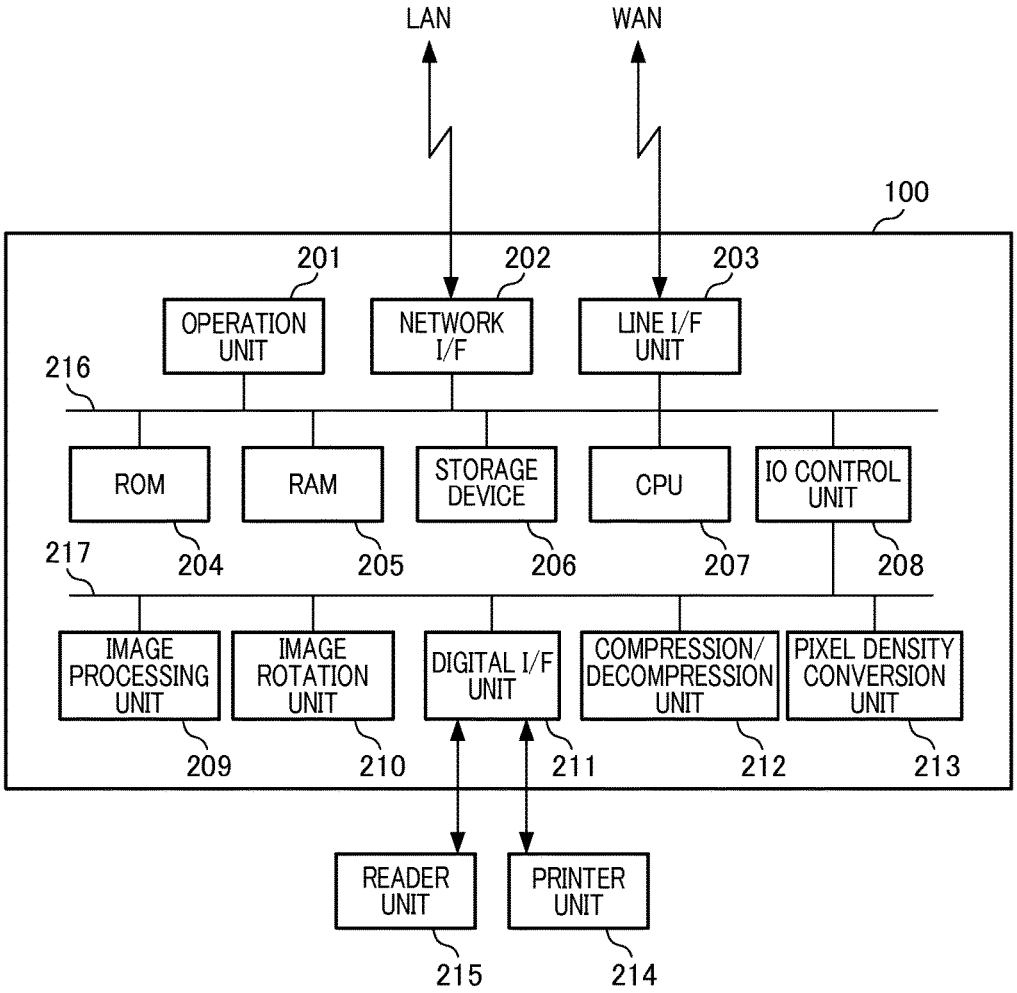
FIG. 2 illustrates an example of a hardware configuration of an image forming device.

FIG. 2 is a block diagram illustrating a hardware configuration of the control unit in the image forming device 100 shown in FIG. 1. The control unit in the image forming device 100 mainly controls programs such as printing and scanning. The control unit also controls a management system program that manages a signal or the like to be transmitted from a sensor for detecting the amount of toner remaining in a toner bottle and a sensor for detecting the replacement of a toner bottle. A container of consumable such as toner or ink is replaceably loaded in the image forming device 100. For example, when the image forming device 100 detects that a toner bottle has been replaced, the image forming device 100 issues event information and then transmits the event information to the management server 105.

The control unit is constituted by a portion for performing system management and a portion for performing image processing management. The components for performing system management are constituted by an operation unit 201, a Network I/F 202, a line I/F unit 203, a ROM 204, a RAM 205, a storage device 206, and a CPU 207, where CPU is an abbreviation for Central Processing Unit, RAM is an abbreviation for Random Access Memory, and ROM is an abbreviation for Read Only Memory. Also, the components for performing image processing management are constituted by an IO control unit 208, an image processing unit 209, an image rotation unit 210, a digital I/F unit 211, a compression/decompression unit 212, and a pixel density conversion unit 213. These components are connected to a system bus 216 and an image bus 217.

The following components are arranged on the system bus 216. The CPU 207 controls the operation unit 201 into which a display unit and a key input unit are built. A user gives instructions for performing various setting regarding scanner reading and print output, as well as giving instructions for starting and stopping operations via a key input unit. Also, a user can confirm the amount of toner remaining in a loaded toner bottle, identification information of the toner bottle, or the like via the operation unit 201.

The Network I/F 202 is an interface unit for connecting with an in-house LAN. The Network I/F 202 communicates with the management server 105 via the in-house LAN 102. For example, the image forming device transmits monitor information of the image forming device 100 to the management server 105 via the Network I/F 202 using an HTTP protocol or an HTTPS protocol.

The line I/F unit 203 is connected to an ISDN or a public telephone network, and data is transmitted to and received from a remote terminal via the line I/F unit 203. The line I/F unit 203 is controlled by a communication control program and data such as facsimile is also transmitted and received via the line I/F unit 203.

The CPU 207 executes a control program for the image forming device 100 and a monitoring program regarding monitor/control of an image forming device stored in the ROM 204 or the storage device 206. The RAM 205 is a work memory for executing programs. The CPU 207 reads out various programs stored in the ROM 204 to the RAM 205 and analyzes the read programs to thereby execute various types of processing. The RAM 205 temporarily stores, for example, status information necessary for a monitoring program (hereinafter simply referred to as "monitoring program") for monitoring an image forming device to manage device information and image data received from the Network I/F 202. The storage device 206 is a non-volatile storage device that stores various types of operation mode settings, counter values (the number of copies printed for each size, the number of times that a document has been read, or the like), status information (including a status flag), and the like, which are required to be held even after the image forming device 100 has been restarted. Setting information stored in the storage device 206 also includes information of the remaining amount of toner in a loaded toner bottle and identification information of the toner bottle. In addition, an operating system of an image forming device, other application programs, and the like are also stored in the storage device 206.

The CPU 207 executes a control program to thereby execute copy processing, print processing, or the like instructed by a user. The monitoring program to be executed by the CPU 207 reads out operation information such as a counter value, an operation log, or the like stored in the storage device 206 and failure information and transmits the read information as status information of the image forming device 100 to the management server 105 via the Network I/F 202.

Monitor information also includes operation information and failure information. Operation information indicates information such as a counter value or an operation log, which is generated upon normal operation. Also, failure information indicates information such as jam or error, which is generated when an image forming device cannot execute normal processing. When the CPU executes the monitoring program to thereby perform toner bottle replacement, the image forming device 100 transmits the fact that the toner bottle has been replaced as event information to the management server 105. When the image forming device 100 transmits event information to the management server 105, the image forming device 100 reads out the remaining amount of toner in the toner bottle loaded prior to the replacement from the storage device 206 and then confirms whether or not the toner bottle has been prematurely removed or has been completely used. In addition, the image forming device 100 confirms identification information of a newly loaded toner bottle, current counter information, or the like and transmits the information by setting it to a predetermined format of event information to be transmitted.

The IO control unit 208 is a bus bridge that connects the system bus 216 and the image bus 217 that transfers image data at high speed. The image bus 217 is constituted by a bus such as PCI bus or IEEE 1394. The following components are arranged on the image bus 217. The digital I/F unit 211 connects a reader unit 215 and a printer unit 214 of the image forming device 100 with the control unit, and converts image data between a synchronous system and an asynchronous system. Also, information detected by various types of the aforementioned sensors provided at various places in the reader unit 215 and the printer unit 214 is sent to the system bus 216 via the digital I/F unit 211 and the IO control unit 208. The image processing unit 209 corrects, manipulates, and edits input and output image data. The image rotation unit 210 rotates image data. The compression/decompression unit 212 performs JPEG compression and decompression processing on multi-value image data, and performs JBIG/MMR/MR/MH compression and decompression processing on binary image data. The pixel density conversion unit 213 performs resolution conversion and the like on output image data.

<Software Module Configuration of the Image Forming Device>

Figure 3:
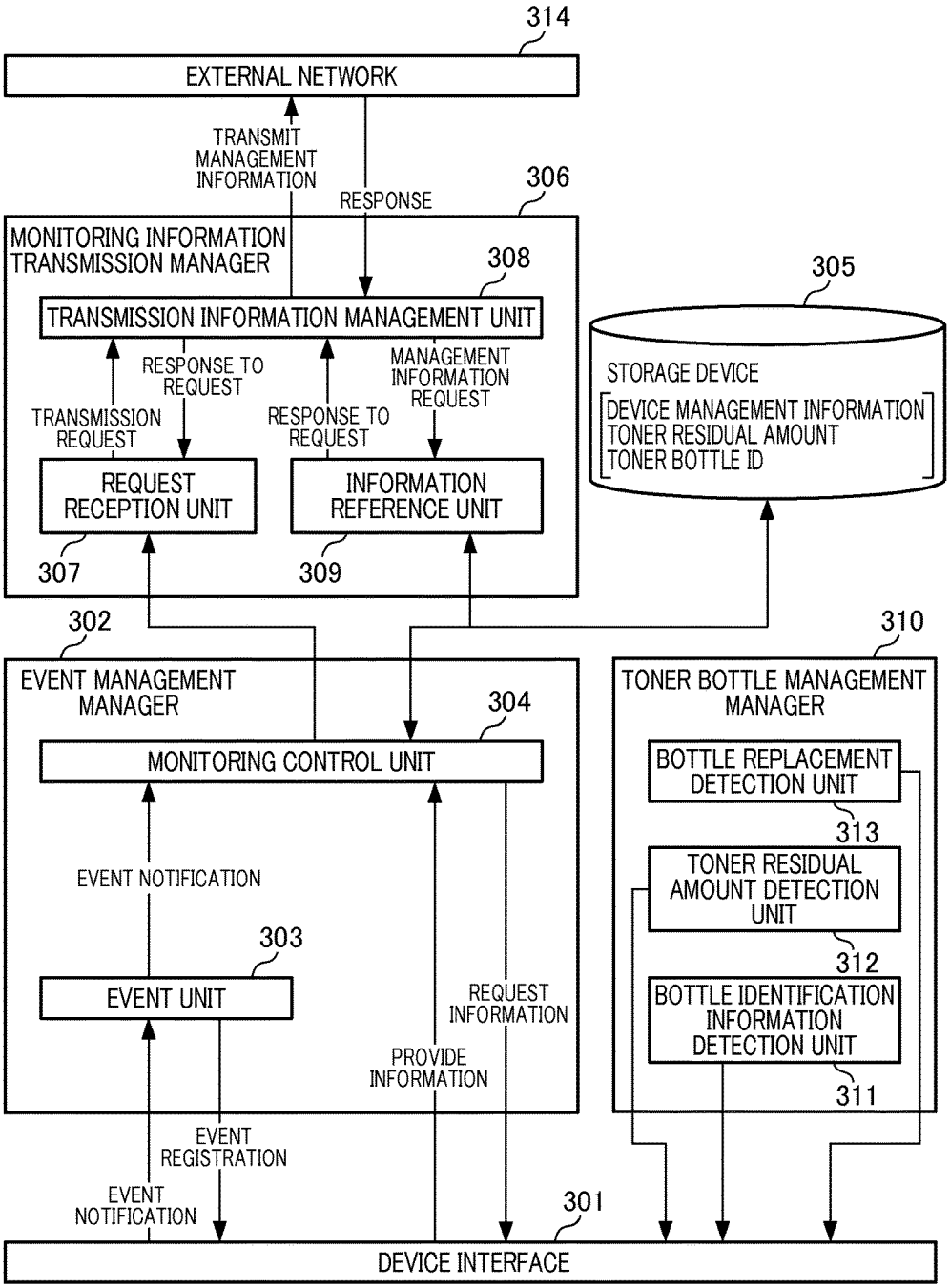
FIG. 3 illustrates an example of a software configuration of an image forming device.

FIG. 3 is a diagram illustrating a configuration of a monitoring program module that is communicable with an external system in the image forming device 100 shown in FIG. 1. Hereinafter, a description will be given of toner bottle replacement event transmission processing. Reference numerals 301 to 313 shown in FIG. 3 indicate the monitoring program modules provided in the image forming device 100. The CPU 207 in the image forming device 100 executes these program modules to thereby realize processing to be described below.

The monitoring program module includes a device interface 301, an event management manager 302, a storage device 305, and a monitor information transmission manager 306. The device interface 301 corresponds to the IO control unit 208 shown in FIG. 2. The event management manager 302 receives the event generated by the image forming device 100 to thereby manage event information. The storage device 305 stores management information required for managing an image forming device. The storage device 305 is a non-volatile memory such as the storage device 206 or the ROM 204. Also, the monitor information transmission manager 306 transmits event information occurred in the image forming device 100 to the management server 105 in a remote place. A toner bottle management manager 310 provides management information of a toner bottle to be loaded in the image forming device 100 to the device interface 301.

The toner bottle management manager 310 includes a bottle identification information detection unit 311, a toner remaining amount detection unit 312, and a bottle replacement detection unit 313. After the replacement of a toner bottle, the bottle identification information detection unit 311 acquires identification information of a newly loaded toner bottle and provides the acquired identification information to the event management manager 302 via the device interface 301. In other words, the bottle identification information detection unit 311 functions as a detection unit that detects identification information of a consumable container to be newly loaded upon replacement of the consumable container.

The toner remaining amount detection unit 312 detects how much toner is left in the loaded toner bottle and provides information of the remaining amount of toner in the toner bottle to the event management manager 302 via the device interface 301. The information of the remaining amount of toner in a toner bottle may be information indicating whether or not the remaining amount of toner is left in a toner bottle or information indicating the exact remaining amount of toner in a toner bottle such as how many percent of toner left in a toner bottle. In other words, the toner remaining amount detection unit 312 functions as a management unit that manages remaining amount information of consumable contained in the loaded consumable container. The bottle replacement detection unit 313 detects the replacement of a toner bottle such as the start or end of a toner bottle replacement via a sensor and notifies the device interface 301 of an event.

The event management manager 302 includes an event unit 303 and a monitoring control unit 304. The event management manager 302 receives various types of event information detected by the toner bottle management manager 310 via the device interface 301 and records information required for managing an image forming device in the storage device 305. Event information managed by the event management manager 302 includes typical status information of an image forming device, such as an event or an error (may also be referred to as "fault") of a print job issued by a user of an image forming device. The event unit 303 receives an event of an image forming device via the device interface 301. The monitoring control unit 304 receives event information from the event unit 303 and then determines countermeasures by determining the type of the event.

For example, the event management manager 302 confirms the remaining amount of toner in a toner bottle for each print job issued by a user and then writes the confirmed remaining amount as information of the latest remaining amount of toner in the toner bottle in the current image forming device in the storage device 305. In addition, an event to be handled by the event management manager 302 includes an error of the image forming device 100. Examples of an error of the image forming device 100 include an emergent error such as a hard disk error, an accounting counter error, or the like, a warning level error such as paper jam, low toner, or the like. Likewise, event information representing toner bottle replacement is also notified to the event management manager 302 via the device interface 301.

When the image forming device 100 is activated, the event unit 303 registers event information to be monitored by the event management manager 302 in the device interface 301. Event information to be registered may be set by an administrator or may also be determined in advance. The event unit 303 performs registration processing so that the event unit 303 receives a notification in real time on occurrence of an event required for monitoring an image forming device. Thus, when an event such as an error to be monitored by the image forming device 100, a toner bottle replacement, or the like occurs, the event unit 303 receives event information via the device interface 301. Also, the event unit 303 immediately notifies the monitoring control unit 304 of the received event information.

When the monitoring control unit 304 receives an event notification from the event unit 303, the monitoring control unit 304 requests the device interface 301 to provide information required for the notification of various events and then receives provision of information from the device interface 301. The monitoring control unit 304 stores relevant information of the event provided from the device interface 301 in the storage device 305. When the monitoring control unit 304 stores event information in the storage device 305, the monitoring control unit 304 issues a request for transmitting the stored event information to the management server to the monitor information transmission manager 306.

The storage device 305 is the ROM 204 and the storage device 206 shown in FIG. 2. The storage device 305 stores device configuration information such as firmware information, the identification number of an image forming device, or the like. Also, the storage device 305 stores management information of an image forming device relating to the occurred event, such as an error code, an error occurrence time, an occurrence time at which the event has occurred, or the like. Also, when the occurred event is a toner bottle replacement event, the storage device 305 stores the following information. In other words, the storage device 305 functions as a management unit that stores information of the remaining amount of toner in a toner bottle loaded prior to the replacement, identification information of a newly loaded toner bottle, counter information of an image forming device at that time in association with a toner bottle replacement event.

The monitor information transmission manager 306 includes a request reception unit 307, a transmission information management unit 308, and an information reference unit 309. The request reception unit 307 receives a transmission request from the monitoring control unit 304 of the event management manager 302. When the request reception unit 307 receives an event transmission request, the request reception unit 307 immediately passes the transmission request to the transmission information management unit 308. When the transmission information management unit 308 receives an event information transmission request from the request reception unit 307, the transmission information management unit 308 requests event information from the information reference unit 309. When the information reference unit 309 receives an event information acquisition request from the transmission information management unit 308, the information reference unit 309 acquires event information from the storage device 305 and returns the event information as a response to the request to the transmission information management unit 308. The transmission information management unit 308 edits the acquired event information in a format of event information format to be transmitted to the management server 105 and transmits the edited event information as management information to the external network 314.

<Example of Configuration of the Control Unit in the Management Server of the Present Embodiment>

Figure 4:
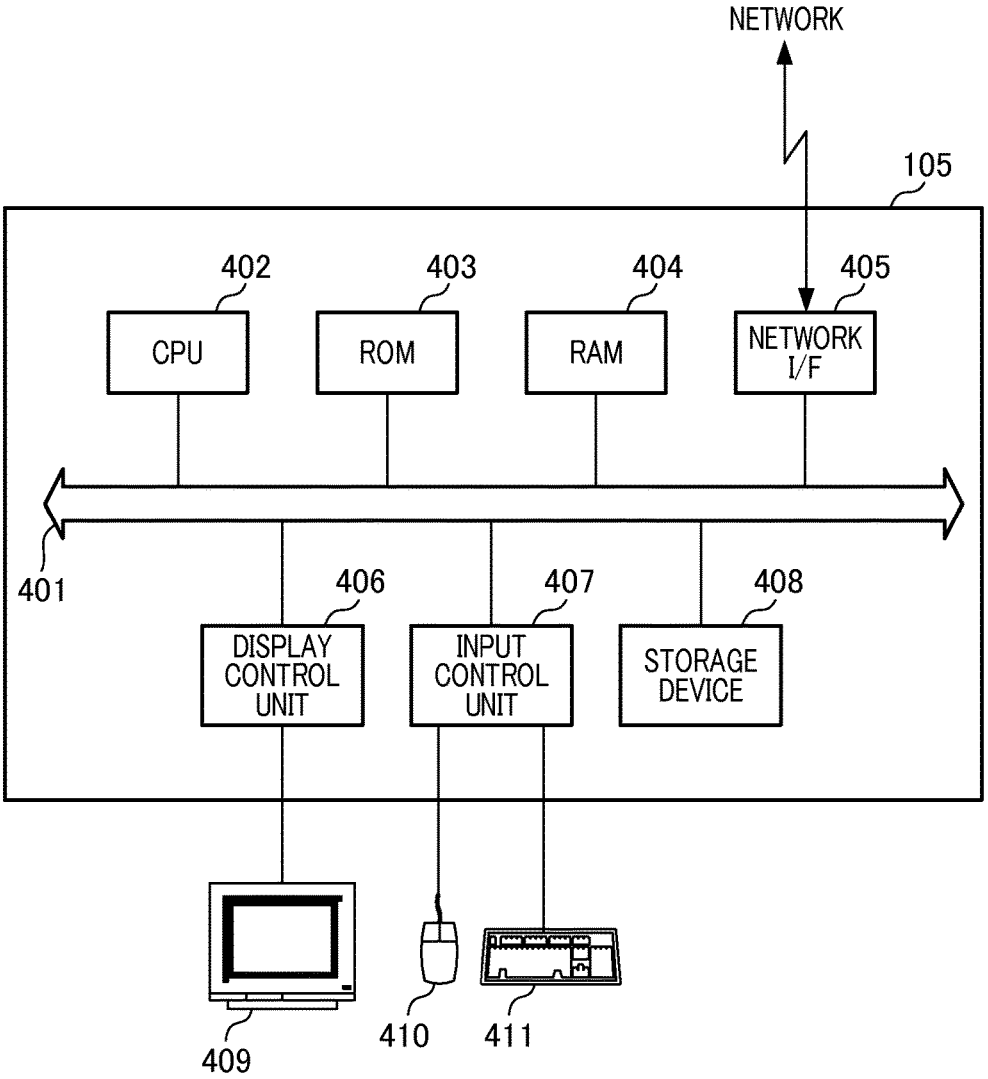
FIG. 4 illustrates an example of a hardware configuration of a management device.

FIG. 4 is a block diagram illustrating the management server 105 that functions as the management device of the present invention. The management server 105 may also be configured by a general computer or the like. The management server includes a CPU 402, a ROM 403, a RAM 404, a Network I/F 405, a display control unit 406, an input control unit 407, and a storage device 408. These components are connected to a bus 401 and data transmission/reception can be made therethrough. The CPU 402 controls the entire management server 105. The ROM 403 is a read only memory for storing a boot program required for system activation. The RAM 404 is a work memory that is required upon execution of a program by the CPU 402. The Network I/F 405 is connected to Network and communicates with other devices. The display control unit 406 displays maintenance content or the like of an image forming device on a display 409, and the input control unit 407 receives input from a user who manages the management server 105 via input devices 410 and 411. In addition, the management server includes the storage device 408 such as a magnetic disk that stores a program to be executed by the CPU 402, maintenance information transmitted from the image forming device 100, or the like.

The management server 105 periodically receives an operation information notification and irregularly receives an abnormal state notification from the image forming device 100 via the Network I/F 405. The abnormal state is a state in which a fault occurs in an image forming device and normal processing cannot be performed and indicates a paper jam state or an error occurring state. Operation information to be periodically reported from the image forming device 100 includes a counter value used for copying or printing, a part counter value for measuring the lifespan of a consumable part, an operation log, and the like. The management server 105 calculates a periodic maintenance fee claimed monthly for a customer who owns the image forming device 100 based on operation information. Also, operation information is output in the form of a report indicating that how much parts used in the image forming device 100 are consumed relative to a suggested lifespan. The management server 105 successively stores the operation information in the storage device 408. On the other hand, an operator who operates the management server 105 determines an amount claimed for a customer by appropriately referencing the stored operation information.

Information representing the abnormal state of the image forming device 100, which is irregularly reported, includes operation information and error/alarm information such as hardware fault or jam occurred. When the management server 105 receives information, the management server 105 determines processing based on a level of urgency of the information. For example, when the management server 105 receives failure information required for taking immediate countermeasures such as a service call error of the image forming device 100 or the like, the management server 105 transmits an email to a service person who manages the image forming device 100 of interest. Furthermore, the management server 105 notifies an operator of the fact that the image forming device 100 is in an abnormal state by successively storing an email in the storage device 408 and displaying it on the display 409. Also, when the management server 105 receives information such as jam or alarm with a low level of urgency, the management server 105 successively stores the received information in the storage device 408 and determines whether the email needs to be transmitted or needs to be displayed on the display 409. On the other hand, the operator determines the state of the image forming device 100 from display content on the display 409 and instructs a service person to perform a fault recovery operation as appropriate. In addition, the operator sends consumable such as toner to a customer.

Information of the image forming device 100 to be irregularly reported also includes a notification for managing toner such as event information representing toner bottle replacement. When the management server 105 receives toner bottle replacement event information from the image forming device 100, the management server 105 performs matching between identification information of each toner bottle and identification information of a newly loaded toner bottle based on management information of toner bottles which have been sent to a customer. Since identification information of a newly loaded toner bottle is included in event information, the management server 105 can perform matching. In this manner, the management server 105 confirms which toner bottle is newly used from among toner bottles that have been sent to a customer.

The management server 105 also acquires information of the remaining amount of toner in the toner bottle loaded prior to the replacement from toner bottle replacement event information. The management server 105 determines whether or not the toner bottle loaded prior to the replacement has been prematurely removed or has been removed after completely used using the information. The management server 105 also acquires counter information of the image forming device upon replacement from toner bottle replacement event information and adds the acquired counter information to toner management information in the management server. With the aid of the aforementioned processing, the management server 105 calculates the number of copies printed by using the toner bottle loaded prior to the replacement. The management server 105 manages whether or not toner is efficiently used by a customer by utilizing these types of information.

<Example of Software Configuration of the Management Server of the Present Embodiment>

Figure 5:
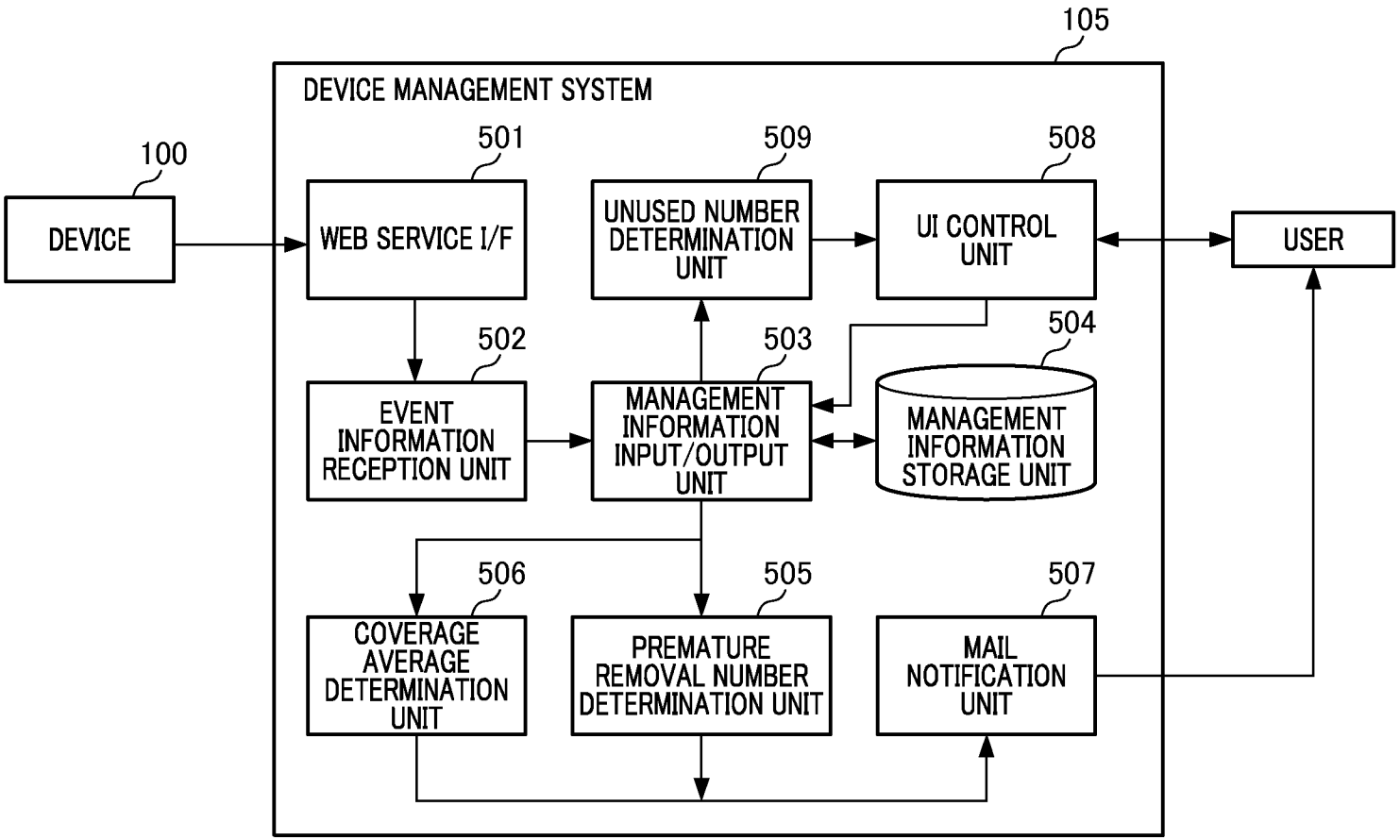
FIG. 5 illustrates an example of a software configuration of a management device.

FIG. 5 is a block diagram illustrating functions of an application program for performing toner management of a device management system in the management server 105. The CPU 402 of the management server 105 executes programs stored in the ROM 403 and the storage device 408 to thereby realize processing to be described below. The device management system includes a Web Service I/F 501, an event information reception unit 502, a management information input/output unit 503, a management information storage unit 504, a premature removal number determination unit 505, and a coverage average determination unit 506. Also, the device management system includes a mail notification unit 507, an UI control unit 508, and an unused number determination unit 509.

The Web Service I/F unit 501 receives monitor information from the image forming device 100. In the present embodiment, event information relating to toner management is particularly described. The event information reception unit 502 functions as a reception unit that receives a replacement notification and receives event information representing toner bottle replacement from the Web Service I/F unit 501. The management information input/output unit 503 functions as a storage unit that stores information included in the toner bottle replacement event information received by the event information reception unit 502 in the management information storage unit 504. More specifically, the management information input/output unit 503 associates toner bottle identification information, counter information regarding the toner bottle replacement, and information of the remaining amount of toner in the toner bottle which has been removed by the replacement with each other and then stores the associated information as management information. Also, the management information input/output unit 503 receives a request for acquiring the toner usage state by a customer from a user via the UI control unit 508 to be described below and then acquires the toner usage state by the corresponding customer from the management information storage unit 504. The management information storage unit 504 controls update and acquisition of toner management information to be stored in the ROM 403 and the storage device 408 shown in FIG. 4.

The premature removal number determination unit 505 determines whether or not the number of toner bottles which have been prematurely removed exceeds a predetermined prescribed value from among the toner bottles used by the customer based on toner bottle management information acquired by the management information input/output unit 503. The coverage average determination unit 506 calculates the average value of coverage indicating the printing density of the toner bottles that have been used by a customer based on the toner bottle management information acquired by the management information input/output unit 503. The coverage average determination unit 506 also determines whether or not the calculated average value of coverage exceeds a prescribed value.

When the premature removal number determination unit 505 determines that the number of toner bottles which have been prematurely removed exceeds a prescribed value or the coverage average determination unit 506 determines that the calculated average value of coverage exceeds a prescribed value, the mail notification unit 507 provides a notification to an operator who uses a device management system. In the present embodiment, the mail notification unit 507 is configured to provide a notification to an operator who uses a device management system but the present invention is not limited thereto. The mail notification unit 507 may also be configured to cause a user who uses an image forming device to recognize the fact that the number of times that the toner bottles have been prematurely removed exceeds a prescribed value or the coverage average value exceeds a prescribed value by transmitting each notification to the image forming device. The UI control unit 508 receives input/output of toner management information from an operator who uses a device management system. The UI control unit 508 displays the toner usage state by a customer and receives input of the serial number of each toner bottle that has been delivered to the customer by toner delivery personnel of a sales company.

The unused number determination unit 509 performs matching between the serial numbers of toner bottles sent from device management system operator to a customer and the serial number included in the toner bottle replacement notification to thereby determine whether or not the number of unused toner bottles exceeds a prescribed value. When the number of unused toner bottles from among the toner bottles sent to a customer exceeds a prescribed value, the unused number determination unit 509 instructs the UI control unit 508 to provide a notification to a device management system operator. In other words, each of the mail notification unit 507 and the UI control unit 508 functions as a notification unit. When the mail notification unit 507 determines that the number of times the toner bottles have been prematurely removed or the coverage average value exceeds a prescribed value or when it is determined that the number of unused toner bottles exceeds a prescribed value, each of the mail notification unit 507 and the unused number determination unit 509 provides a notification to an operator or the like.

<Example 1 of Communication Data of Event Information Received by the Management Server>

Figure 6:
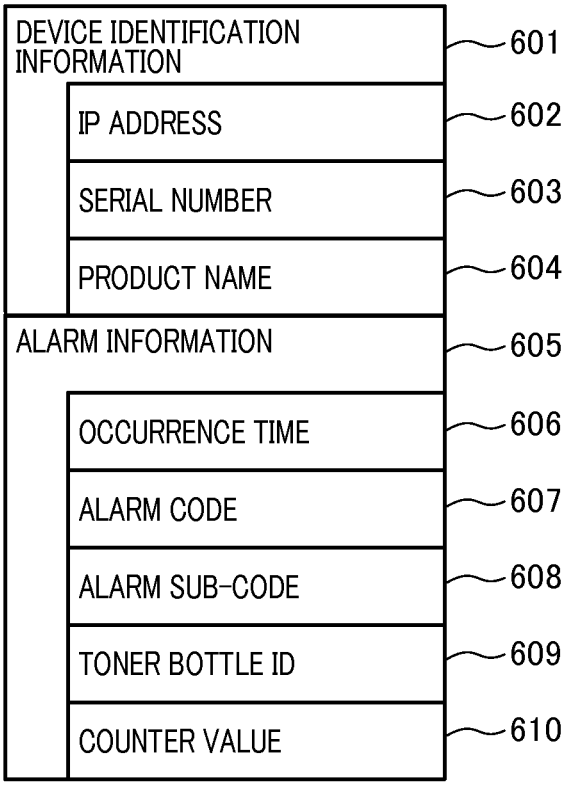
FIG. 6 illustrates an example of an alarm received by a management device.

FIG. 6 is a diagram illustrating communication data of event information representing toner bottle replacement, where event information is received by the management server 105 from the image forming device 100 or the site monitoring device 101. The image forming device 100 or the site monitoring device 101 generates event information at a timing at which a new toner bottle is loaded in the image forming device 100.

Communication data shown in FIG. 6 schematically represents the structure of event information. The event information is described in, for example, XML format and is further transmitted to the management server 105 via an encrypted protocol such as an HTTPS communication or the like. The management server 105 is notified of event information representing toner bottle replacement as alarm information of an image forming device. In the present embodiment, an alarm of an image forming device is not a fault of an image forming device but is defined as an event to be reported or recorded. An alarm of an image forming device is not limited to toner bottle replacement but also includes an event such as "out-of-paper", "no stapling", or the like. Each of these events is managed by a code and there is a code corresponding to an event representing toner bottle replacement.

Information included in event information representing toner bottle replacement shown in FIG. 6 is constituted by device identification information 601 and alarm information 605. The device identification information 601 is information for identifying an image forming device. In the present embodiment, the device identification information 601 includes information such as an IP address 602, a serial number 603, a product name 604, and the like. The alarm information 605 is information representing the content of an event occurred in the image forming device 100 and includes information such as an occurrence time 606, an alarm code 607, an alarm sub-code 608, a toner bottle ID 609, and a counter value 610.

The occurrence time 606 represents a time at which toner bottle replacement is detected by the bottle replacement detection unit 313. The occurrence time may be a time at which a toner bottle is removed or may also be a time at which a new toner bottle is loaded. The alarm code 607 represents the event content occurred in an image forming device. In the present embodiment, the alarm code 607 represents the occurrence of a toner bottle replacement event. The alarm sub-code 608 represents relevant information relating to toner bottle replacement, such as information of the remaining amount of toner in a toner bottle upon removal of the toner bottle prior to the replacement, color information of toner to be replaced, or the like by subcoding.

The toner bottle ID 609 represents the serial number of a toner bottle loaded in the image forming device 100. Also, the counter value 610 represents a total counter value counted by the image forming device 100 upon loading of a toner bottle. In the present embodiment, a total counter for counting the number of copies printed output by the image forming device 100 is used in order to analyze the usage trend of the image forming device 100 from the loading of a toner bottle up to the replacement of the toner bottle with a next toner bottle. In the present invention, counter information representing the number of times of use of a part or the like through which the usage trend of the image forming device 100 can be determined can also be applicable instead of a total counter. Since the counter value 610 can likewise grasp the trend, counter information upon removing a toner bottle may also be used.

(First Embodiment)

<Example 1 of Operation Performed by the Image Forming Device>

Figure 7:
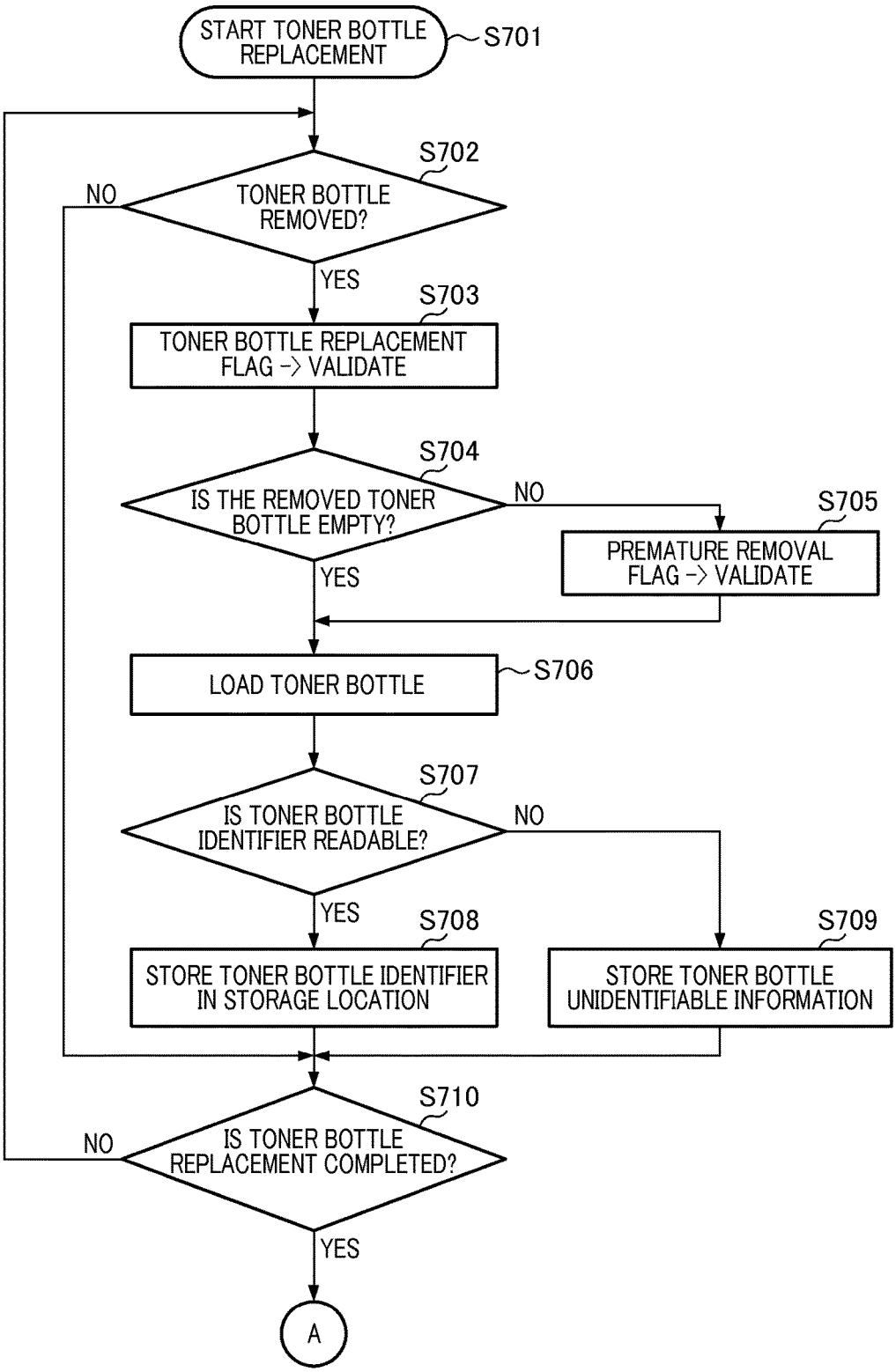
FIG. 7 illustrates processing performed until an image forming device transmits an alarm to a management device.
Figure 8:
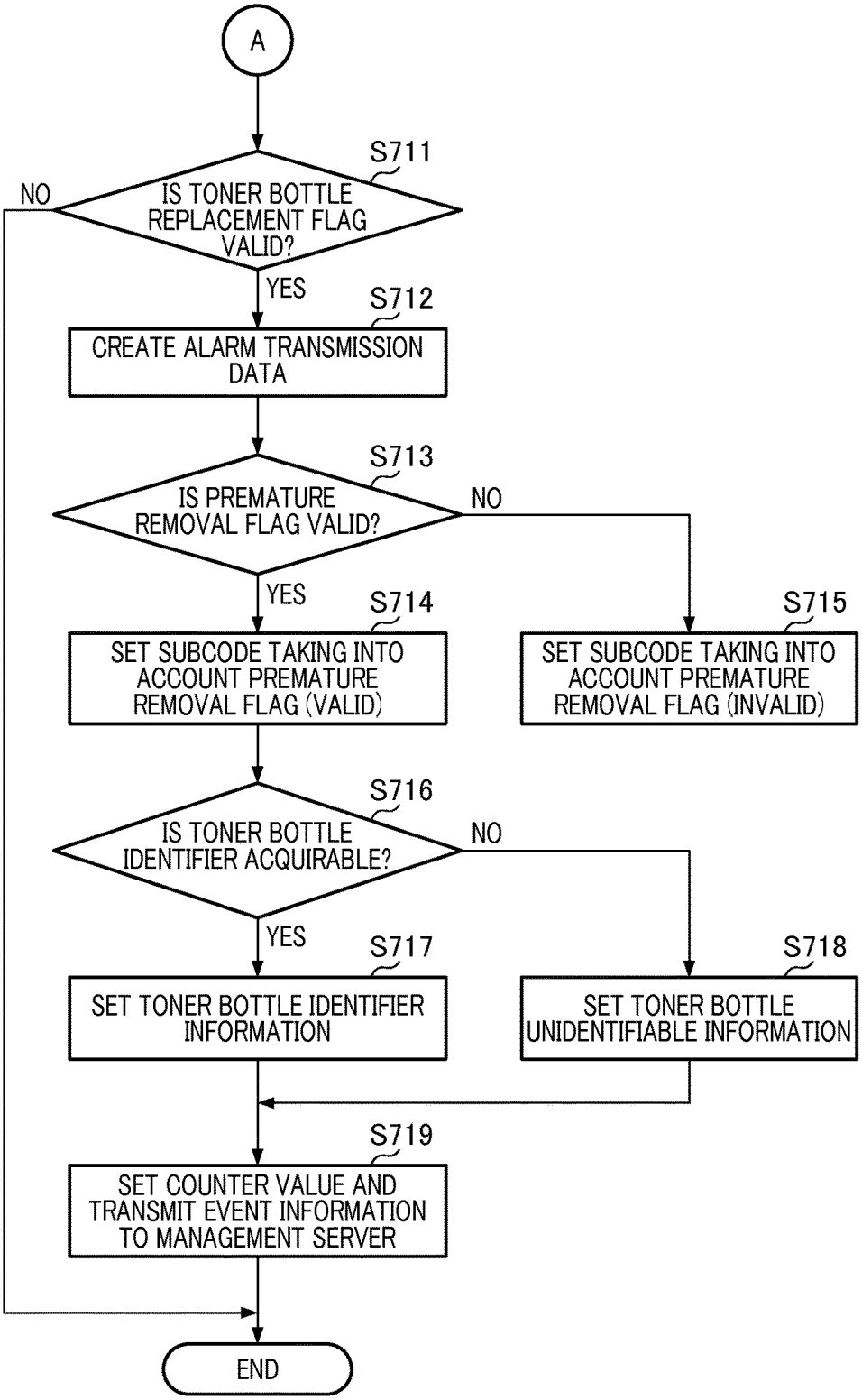
FIG. 8 illustrates processing performed until an image forming device transmits an alarm to a management device.

A description will be given of an exemplary operation performed by the image forming device 100 of the present embodiment based on the above configuration. FIGS. 7 and 8 are flowcharts illustrating processing from the start of toner bottle replacement by a user who uses the image forming device 100 up to the transmission of a toner bottle replacement notification from the image forming device 100 to the management server 105. The processing in the flowchart is realized by executing a program stored in either the ROM 204 or the storage device 206 by the CPU 207.

In step S701, a user who uses the image forming device 100 opens the door of the image forming device in order to perform toner bottle replacement. In step S702, the bottle replacement detection unit 313 of the toner bottle management manager 310 detects the removal of a toner bottle and the device interface 301 is notified of event information. Then, the process shifts to step S703. When a user opens the door of the image forming device but no toner bottle is removed therefrom, the process shifts to step S710.

In step S703, upon receiving the detection of the removal of a toner bottle by the bottle replacement detection unit 313 in step S702, the event unit 303 receives an event notification from the device interface 301 and passes the received event notification to the monitoring control unit 304. Upon receiving event notification, the monitoring control unit 304 sets a toner bottle replacement flag to the storage device 305. In the flag setting, the monitoring control unit 304 stores the fact that which color toner bottle becomes the target for replacement and thus is removed from the image forming device in the storage device 305. Thus, the management server 105 can perform toner bottle management with accuracy even when a plurality of toner bottles is replaced with new ones. When the setting processing is completed, the process advances to step S704.

In step S704, when the toner remaining amount detection unit 312 detects the remaining amount of toner, the toner remaining amount detection unit 312 provides an event notification to the event unit 303 via the device interface 301. The monitoring control unit 304 of the event management manager 302 determines whether or not the toner bottle removed by receiving the event notification from the event unit 303 is empty. When there is no remaining amount in a toner bottle prior to replacement, the process advances to step S706. When there is a remaining amount in a toner bottle prior to replacement, the process advances to step S705. In step S705, the monitoring control unit 304 of the event management manager 302 validates a premature removal flag by associating it with information of the removed toner bottle and then stores the premature removal flag in the storage device 305.

In step S706, the bottle replacement detection unit 313 detects the fact that the toner bottle has been loaded and the process advances to step S707. In step S707, the bottle identification information detection unit 311 of the image forming device 100 determines whether or not the bottle identifier described in a newly loaded toner bottle is readable. The identifier is added to a toner bottle in the form of a barcode or an IC and is read by a sensor. When the bottle identification information detection unit 311 fails to read the bottle identifier due to the influence of contamination on a barcode or deficiencies in IC, the process advances to step S709. When the bottle identification information detection unit 311 successfully reads the bottle identifier, the process advances to step S708. In step S708, the monitoring control unit 304 receives the toner bottle identifier acquired by the bottle identification information detection unit 311 in step S707 via the event unit 303 and stores the toner bottle identifier in the storage device 305. Then, the process advances to step S710.

When the bottle identification information detection unit 311 fails to read the toner bottle identifier in step S707, the monitoring control unit 304 stores a flag indicating the fact that the toner identifier cannot be recognized in the storage device 305 in step S709, and the process advances to step S710. In step S710, the bottle replacement detection unit 313 of the toner bottle management manager 310 detects the fact that the replacement of the toner bottle is completed and the door of the image forming device 100 is closed. When the monitoring control unit 304 receives an event notification from the event unit 303 and determines that the replacement of the toner bottle is completed, the process advances to step S711. When the door is not closed and the replacement of another toner bottle starts, the process advances to step S702 and replacement processing for another toner bottle is performed. In the above processing, the device interface 301 provides a notification to the event unit 303 each time a toner bottle is removed from the image forming device, a new toner bottle is loaded therein, and the identifier of the newly loaded toner bottle is read out. However, the present invention is not limited to the above configuration but a device interface may also provide a notification to the event unit 303 when a toner bottle is removed from the image forming device, a new toner bottle is loaded therein, and the identifier of the newly loaded toner bottle is read out.

The processes in steps S711 to S719 are shown in FIG. 8. In step S711 and subsequent steps, the monitoring control unit 304 of the event management manager 302 prepares for issuing a toner bottle replacement notification after the replacement of the toner bottle. In step S711, the monitoring control unit 304 confirms whether or not a toner bottle is replaced with a new one during the toner bottle replacement processing from step S701 to step S710 and a toner bottle replacement flag is set to the storage device 305. When no toner bottle replacement flag is set, the monitoring control unit 304 ends processing for issuing a toner bottle replacement notification. In other words, when a user opens the door in order to replace a toner bottle but no toner bottle replacement is performed without removing the toner bottle, the monitoring control unit 304 ends processing. Also, when a toner bottle replacement flag is stored in the storage device 305, the process advances to step S712.

In step S712, the request reception unit 307 receives an event information transmission request for replacing a toner bottle from the monitoring control unit 304 and passes the transmission request to the transmission information management unit 308. The transmission information management unit 308 starts to create transmission data for transmitting toner bottle replacement event information. In other words, an alarm code indicating the occurrence of a toner bottle replacement event is set as transmission data to the alarm code 607 shown in FIG. 6. Then, the process advances to step S713.

In step S713, the information reference unit 309 accesses the storage device 305 by receiving a management information request from the transmission information management unit 308 to thereby confirm whether or not a premature removal flag is validated. When the premature removal flag is validated, the flag indicates the fact that the toner bottle removed upon toner bottle replacement in this time was removed in a state where toner still remains in the toner bottle. When a premature removal flag is set, the information reference unit 309 advances the process to step S714. Also, when no premature removal flag is set, the monitoring control unit 304 advances the process to step S715.

In step S714, the transmission information management unit 308 determines a subcode by receiving a response to the request from the information reference unit 309. In other words, the transmission information management unit 308 determines an alarm subcode indicating the color of toner to be replaced and the fact that a toner bottle has been removed upon toner bottle replacement in this time in the state where toner still remains in the toner bottle. Then, the transmission information management unit 308 sets the determined subcode to transmission data. On the other hand, in step S715, the transmission information management unit 308 determines the corresponding alarm subcode from the color of toner to be replaced and information indicating no remaining amount of toner in a toner bottle prior to replacement and sets the alarm subcode to alarm transmission data. Then, the process advances to step S716.

In step S716, the information reference unit 309 receives a management information request from the transmission information management unit 308 to thereby determine whether or not toner bottle identifier information is stored in the storage device 305. When the information reference unit 309 determines that toner bottle identifier information is stored in the storage device 305, the process advances to step S717. Also, when the information reference unit 309 determines that the bottle replacement detection unit 313 cannot acquire toner bottle identifier information and no identifier information is stored in the storage device 305, the process advances to step S718.

In step S717, the transmission information management unit 308 receives a response to the request from the information reference unit 309 and sets a toner bottle ID indicating toner bottle identifier information to alarm transmission data, and the process advances to step S719. In step S718, the transmission information management unit 308 sets information indicating that toner bottle identifier information could not be acquired to alarm transmission data, and the process advances to step S719. Information indicating that toner bottle identification information could not be acquired may be set as an error to the toner bottle ID 609 or may also be set to the alarm sub-code 608.

In step S719, the transmission information management unit 308 transmits a management information request to the information reference unit 309, and receives a total count value as the number of copies printed counted by the image forming device 100 from the information reference unit 309 upon completion of toner bottle replacement. The transmission information management unit 308 sets the counter value 610 indicating the received counter information to the created alarm transmission data, and transmits alarm information to the management server 105. When transmission is completed, the image forming device 100 ends transmission processing for event information representing toner bottle replacement. In other words, the transmission information management unit 308 functions as a transmission unit that transmits a replacement notification including the detected identification information, counter information, and remaining amount information of consumable contained in the previously loaded consumable container which has been removed by the replacement to the management device. In the above processing, the transmission information management unit 308 transmits a request to the information reference unit 309 for each request to create alarm transmission data. Of course, the transmission information management unit 308 may also be configured to totally make requests required for creating alarm transmission data to the information reference unit 309.

<Example of a Toner Management Table in the Management Server 105>

FIG. 9 is a diagram illustrating customer toner management information in DB managed by the management information storage unit 504 in the management server 105 shown in FIG. 5. The toner management table in DB schematically represents the structure of toner management information and the information described in FIG. 9 is relational database in practice and is constituted by a plurality of tables. The toner management table shown in FIG. 9 includes fields storing delivered bottle identifier, device identifier, bottle identifier, toner bottle replaced date/time, counter value at the start of use, counter value at the end of use, actual usage counter, and bottle remaining amount state upon removal. The counter value at the start of use, the counter value at the end of use, and the actual usage counter are counter information indicating the operation status of an image forming device.

The delivered bottle identifier is a field for storing the identifier of a toner bottle sent to a customer by a sales company. Upon sending a toner bottle to a customer, a toner delivery personnel in the sales company inputs the serial number of each toner bottle to the field via the input devices 410 and 411. Of course, the serial number may also be input automatically by utilizing a device such as a barcode reader, an IC scanner, or the like.

The device identifier on the toner management table is the identifier of the image forming device 100 for maintenance. When the management information input/output unit 503 receives a toner bottle replacement alarm, the management information input/output unit 503 additionally writes appropriate data on the toner management table with reference to an image forming device ID in the alarm. The bottle identifier on the toner management table is the identifier of a toner bottle that has been newly loaded in the image forming device 100 when toner bottle replacement is performed on the image forming device 100 for maintenance. When the management information input/output unit 503 receives a toner bottle replacement alarm, the management information input/output unit 503 additionally writes appropriate data on the toner management table with reference to a toner bottle identifier in the alarm.

The toner bottle replaced date/time on the toner management table is a date/time at which toner bottle replacement is performed on an image forming device for maintenance. When received a toner bottle replacement alarm, the management information input/output unit 503 additionally writes appropriate data on the toner management table with reference to an alarm occurred date/time in the alarm. The counter at the start of use on the toner management table is the counter value in an image forming device when a newly loaded toner bottle has been started for use upon toner bottle replacement on the image forming device for maintenance. When received a toner bottle replacement alarm, the management information input/output unit 503 additionally writes appropriate data on the toner management table with reference to a counter value in the alarm. The counter at the end of use on the toner management table is the counter value in an image forming device when a newly loaded toner bottle has been ended for use upon toner bottle replacement on the image forming device for maintenance. When received a toner bottle replacement alarm, the management information input/output unit 503 additionally writes appropriate data on the toner management table with reference to an alarm occurred date/time in the alarm.

The actual usage counter on the toner management table is counter information involved in one toner bottle. In other words, the actual usage counter is a counter value representing the number of copies used from the loading of a toner bottle of interest in the image forming device 100 up to the removal thereof from the same. The counter value is obtained by calculating the difference between the counter at the end of use and the counter at the start of use by the management information input/output unit 503. The bottle remaining amount state upon removal on the toner management table is the remaining amount state of toner in a toner bottle when toner bottle replacement is performed on an image forming device for maintenance. The bottle remaining amount state upon removal is a value indicating either the fact that there is a remaining amount of toner left in a toner bottle upon removal thereof prior to replacement and thus the toner bottle has been prematurely removed or the fact that there is no remaining amount of toner left in a toner bottle upon removal thereof prior to replacement and thus the emptied toner bottle has been removed. When received a toner bottle replacement alarm, the management information input/output unit 503 acquires the remaining amount state of toner in a toner bottle with reference to a subcode in the alarm and additionally writes appropriate data on the toner management table.

The toner bottle replacement alarm includes two types of information: information of a toner bottle removed from the image forming device 100 and information of a toner bottle newly loaded in the image forming device 100.

Information of a toner bottle removed from an image forming device includes remaining amount information of a toner bottle removed by the replacement described in the alarm sub-code 608 shown in FIG. 6, a counter value, and color information of toner to be replaced. The management information input/output unit 503 acquires the serial number 603 (FIG. 6) which is identification information of an image forming device from a toner bottle replacement alarm and specifies a record having the same serial number as the acquired serial number on the toner management table. On the basis of the above information, remaining amount information of a toner bottle removed by the replacement and a counter value at the end of use are additionally written on the specified record. Then, the management information input/output unit 503 acquires an actual usage counter value by calculating the difference between the counter value at the end of use and the counter value at the start of use and additionally writes the actual usage counter value on a record of interest.

Information of a toner bottle newly loaded in the image forming device 100 includes the toner bottle ID 609 which is toner bottle identification information described with reference to FIG. 6 and the counter value 610. When received a toner bottle replacement notification, the management information input/output unit 503 searches the toner bottle ID of a toner bottle newly loaded in an image forming device from the list of delivered bottle identifiers on the toner management table. When the toner bottle ID 609 matches the searched toner bottle ID, the management information input/output unit 503 additionally writes the received device identifier and bottle identifier, the toner bottle replaced date/time, and the counter at the start of use on the same record.

When the toner bottle ID 609 matches the searched toner bottle ID but the toner bottle is provided with a previously-used history and the bottle remaining amount state upon previous toner bottle removal is premature removal, a new record is created and the same information is additionally written on the new record. With the aid of such management techniques, the total number of unused toner bottles that have already been delivered to a customer, the total number of toner bottles that have already been delivered to a customer but have been prematurely removed without being completely used, and the usage trend of each toner bottle can be confirmed.

<Example 1-1 of Operation Performed by the Management Server>

Figure 10:
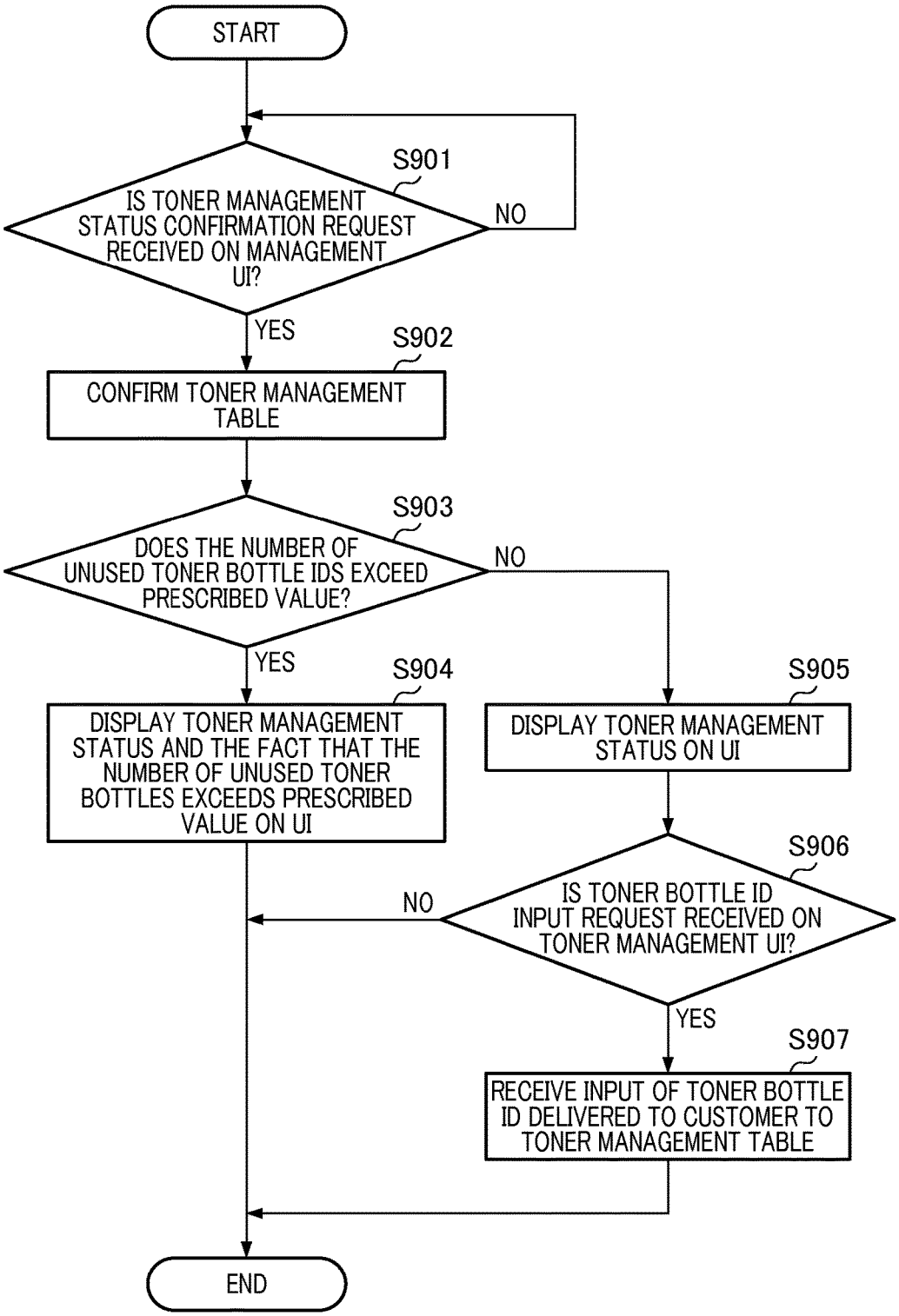
FIG. 10 illustrates processing performed until a management device displays a toner bottle management screen.

A description will be given of Example 1-1 of operation performed by the management server 105 of the present embodiment based on the above configuration. FIG. 10 is a flowchart illustrating processing from the transmission of a request for confirming the status of a toner bottle to a device management system when an operator of the management server 105 sends a toner bottle to a customer up to the completion of input of a toner bottle ID to the device management system. The processing in the flowchart is stored in either the ROM 403 or the storage device 408 shown in FIG. 4, is expanded on the RAM 404 as appropriate, and is executed by the CPU 402. Also, the processing in the flowchart is processing performed by the management information input/output unit 503, the management information storage unit 504, the UI control unit 508, and the unused number determination unit 509 shown in FIG. 5.

When an operator of the management server 105 issues a confirmation request to a device management system in order to confirm the management status of a toner bottle, the UI control unit 508 of the management server 105 starts toner bottle management status reply processing in step S901. In step S902, the UI control unit 508 confirms the toner management table stored in the management information storage unit 504 via the management information input/output unit 503, and the process advances to step S903.

In step S903, the unused number determination unit 509 confirms the toner management table and confirms the number of unused toner bottles by comparing bottle identifier information of toner bottles that have already been delivered to a customer with bottle identifier information of toner bottles that have already been used. When the unused number determination unit 509 determines that the number of unused toner bottles exceeds a prescribed value, the process advances to step S904. When the unused number determination unit 509 determines that the number of unused toner bottles does not exceed a prescribed value, the process advances to step S905.

In step S904, the UI control unit 508 displays a screen as shown in FIG. 20 indicating the toner management information acquired from the toner management table and the fact that the number of unused toner bottles exceeds a prescribed value to an operator of the device management system, and the process ends. In this manner, an operator of the device management system can call attention to a user of an image forming device who stocks many unused toner bottles. In step S905, the UI control unit 508 displays the toner management information acquired from the toner management table, and the process advances to step S906.

In step S906, the UI control unit 508 determines whether or not identification information of one or more toner bottles to be delivered to a customer has been received from the operator of the device management system. Here, when identification information of one or more toner bottles to be delivered to a customer has been received from the operator of the device management system, the process advances to step S907. When identification information of one or more toner bottles to be delivered to a customer has not been received, the process ends. In step S907, the UI control unit 508 receives input of identification information of one or more toner bottles to be delivered to a customer from the operator of the device management system and then updates the toner management table. Then, the process ends.

<Example 1-2 of Operation Performed by the Management Server>

Figure 11:
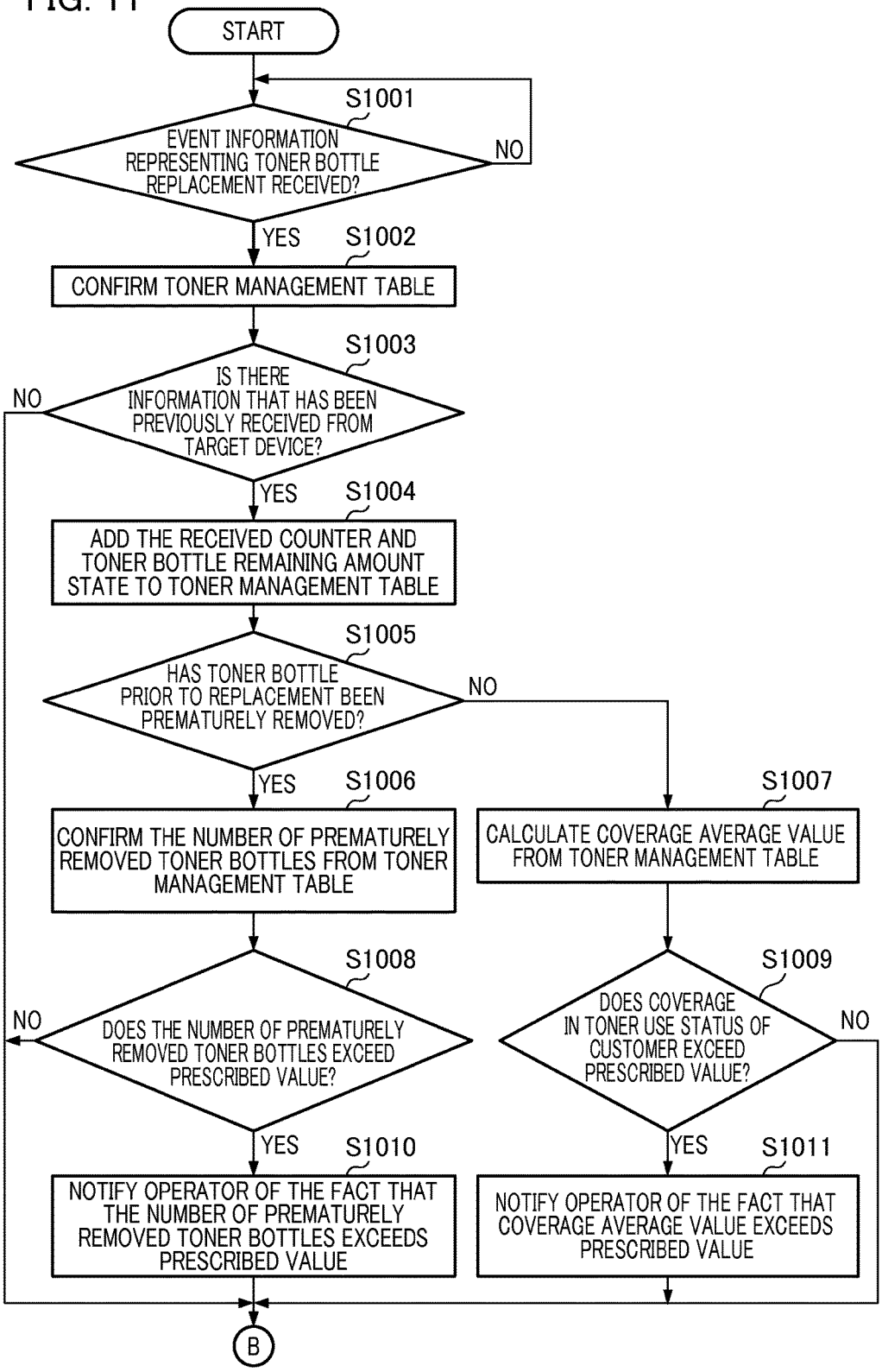
FIG. 11 illustrates processing for receiving an alarm and creating a management table by a management device.

A description will be given of Example 1-2 of operation performed by the management server 105 of the present embodiment based on the above configuration. FIG. 11 is a flowchart illustrating processing from the update of the toner management table by the management server 105 to the prompt of a user to confirm a use method. The management server 105 receives a toner replacement notification, and confirms the total number of toner bottles that have not been completely used and the usage trend of each toner bottle. The processing in the flowchart is realized by expanding a program stored in either the ROM 403 or the storage device 408 shown in FIG. 4 on the RAM 404 and by executing the program by the CPU 402 as appropriate. Also, the processing in the flowchart is processing performed by the event information reception unit 502, the management information input/output unit 503, the management information storage unit 504, the premature removal number determination unit 505, the coverage average determination unit 506, and the mail notification unit 507 shown in FIG. 5.

When a toner bottle replacement notification is transmitted from the image forming device 100 and the management server 105 receives data via the Web Service I/F 501, toner bottle replacement notification reception processing starts. When the event information reception unit 502 receives event information representing toner bottle replacement in step S1001, the process advances to step S1002. In step S1002, the management information input/output unit 503 acquires and confirms information from the toner management table stored in the management information storage unit 504. Then, the process advances to step S1003.

In step S1003, the management information input/output unit 503 confirms whether or not there is event information that has been previously received from the received image forming device using the toner management table. In other words, the management information input/output unit 503 confirms whether or not the identifier of a toner bottle newly loaded in the image forming device 100 upon toner bottle replacement on the image forming device 100 for maintenance is described in the bottle identifier on the toner management table shown in FIG. 9. Here, when there is a reception history of event information indicating previous toner bottle replacement, where the event information has been transmitted by the same image forming device, the process advances to step S1004. When there is no reception history of event information indicating previous toner bottle replacement, where the event information has been transmitted by the same image forming device, the process advances to step S1012.

In step S1004, the management information input/output unit 503 adds the counter at the end of use and the bottle remaining amount state upon removal to the record of interest based on the event information indicating toner bottle replacement received from the event information reception unit 502. In other words, when the device identifier and the bottle identifier have already been stored, the management information input/output unit 503 sets event information corresponding to the toner bottle removed by replacement as management information. Also, the management information input/output unit 503 calculates the difference between a counter at the start of use and a counter at the end of use, and adds the difference to an actual usage counter relating to the toner bottle of interest to complete update of the record of interest. Then, the process advances to step S1005.

In step S1005, the management information input/output unit 503 confirms the remaining amount state of toner in a toner bottle prior to replacement, where the remaining amount state is included in the received event information representing toner bottle replacement, and confirms whether or not the replaced toner bottle has been prematurely removed. Here, when the replaced toner bottle has been prematurely removed, the process advances to step S1006. When the replaced toner bottle has been completely used, the process advances to step S1007.

In step S1006, the premature removal number determination unit 505 confirms the toner management table updated in step S1004. When the toner bottle prior to replacement has been prematurely removed, the premature removal number determination unit 505 confirms the number of prematurely removed toner bottles, and the process advances to step S1008.

In step S1007, the coverage average determination unit 506 confirms the toner management table updated in step S1004, and confirms the total number of copies printed for each used-up toner bottle. When a toner bottle temporarily removed in the middle of use is again loaded in an image forming device and then is used up, that additional count is added to both the actual counter value of toner bottles prematurely removed and the actual counter value of toner bottles used up on the toner management table. In this manner, the number of copies printed from the start of usage to the end of usage of each toner bottle can be calculated. The coverage average determination unit 506 calculates coverage representing the printing density of each toner bottle from the number of copies printed by each toner bottle to thereby determine an average value. Then, the process advances to step S1009.

In step S1008, the premature removal number determination unit 505 confirms whether or not the number of prematurely removed toner bottles exceeds a prescribed value. When the premature removal number determination unit 505 determines that the number of prematurely removed toner bottles exceeds a prescribed value, the process advances to step S1010. When the number of prematurely removed toner bottles does not exceed a prescribed value, the process advances to step S1012.

In step S1009, the coverage average determination unit 506 confirms whether or not the average value of coverage representing the printing density of each toner bottle in the toner usage state of a customer exceeds a prescribed value. When the coverage average determination unit 506 determines that the average value of coverage representing the printing density of each toner bottle exceeds a prescribed value, the process advances to step S1011. When the average value of coverage representing the printing density of each toner bottle does not exceed a prescribed value, the process advances to step S1012.

Figure 18:
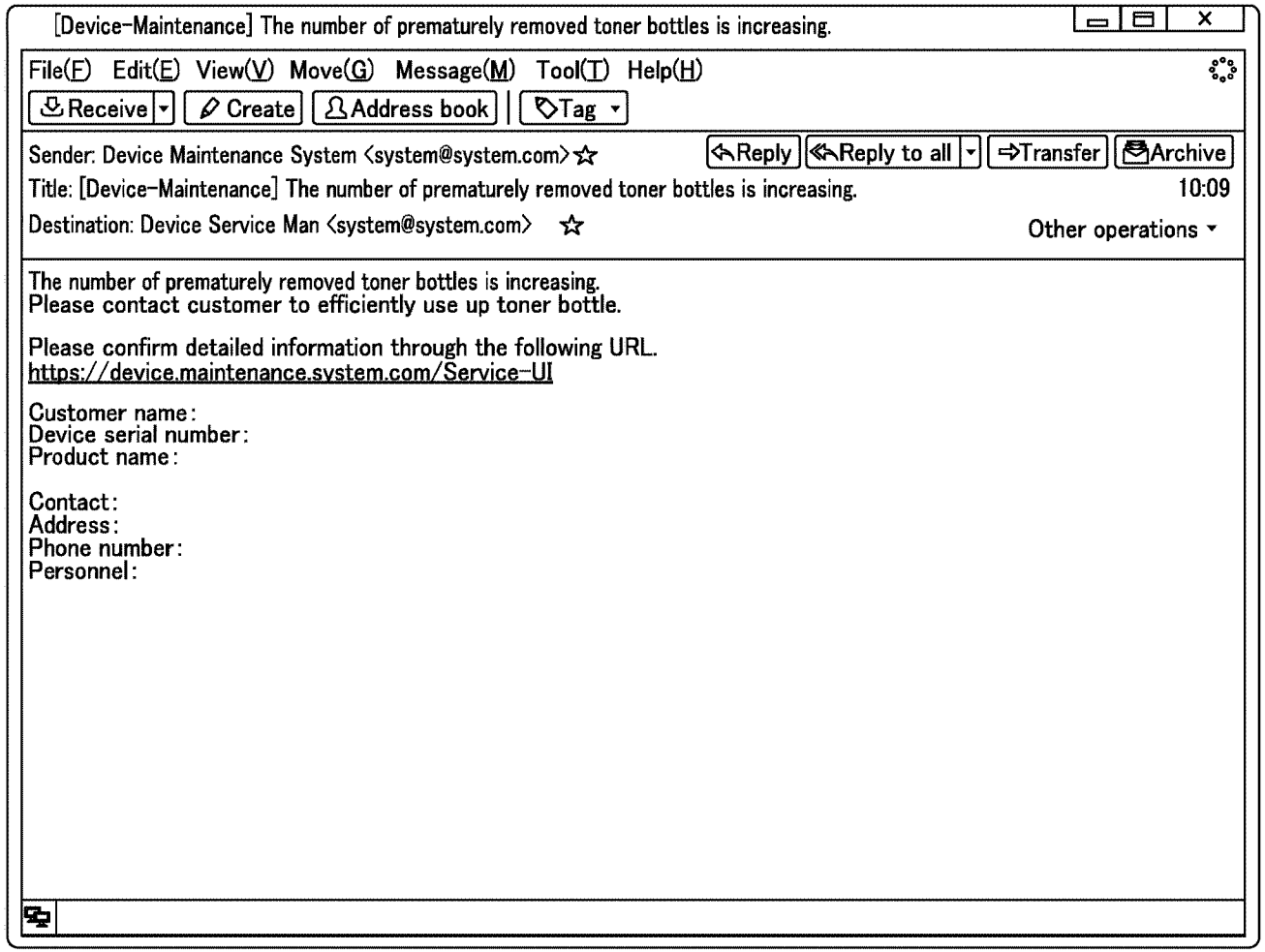
FIG. 18 is illustrates an example of a notification which is notified to a user by a management device.

In step S1010, the mail notification unit 507 receives a request from the premature removal number determination unit 505 to notify the operator of the device management system of the fact that the number of prematurely removed is increasing. Then, the mail notification unit 507 transmits the mail as shown in FIG. 18 to the operator of the device management system. Here, the operator refers to the personnel of an image forming device sales company or the personnel of a company which provides maintenance contract with a customer, who delivers a stock item or sends a service person to the customer. In this manner, the operator can call attention to a user of an image forming device to use up the toner bottle. Then, the process advances to step S1012.

Figure 19:
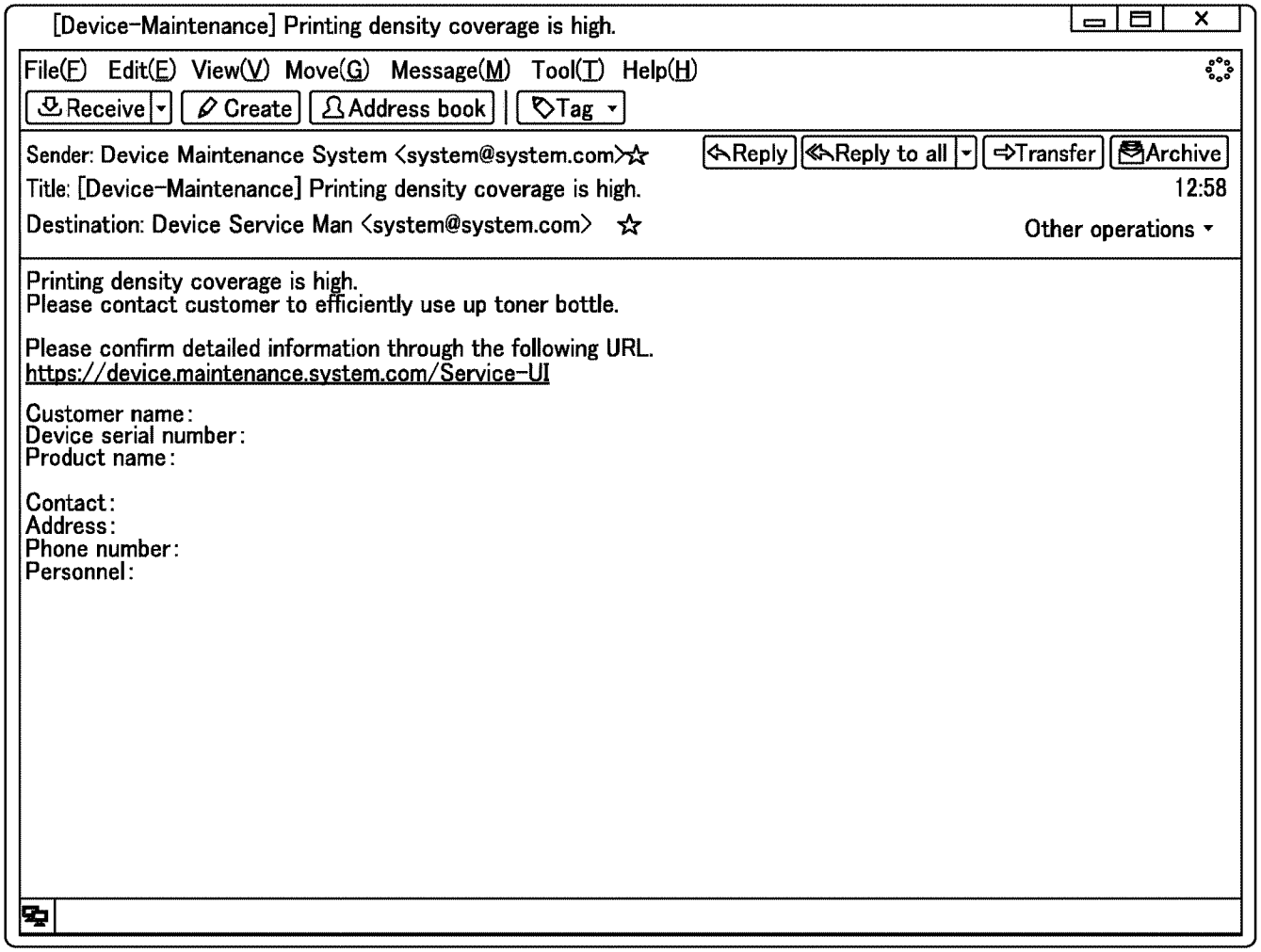
FIG. 19 illustrates an example of another notification which is notified to a user by a management device.

In step S1011, the mail notification unit 507 receives a request from the toner coverage average determination unit 508 to notify the operator of the device management system of the fact that the coverage indicating the printing density used by the customer exceeds a prescribed value. The mail notification unit 507 that has received the mail notification request transmits the mail as shown in FIG. 19 to the operator of the device management system. In this manner, the operator of the device management system can call attention to the user of the image forming device to lower the printing density. As described in FIG. 10 and FIG. 11, the unused number determination unit 509, the premature removal number determination unit 505, and the coverage average determination unit 506 function as a determination unit that determines whether or not the administrator is notified of toner-related information. Then, the process advances to step S1012.

Figure 12:
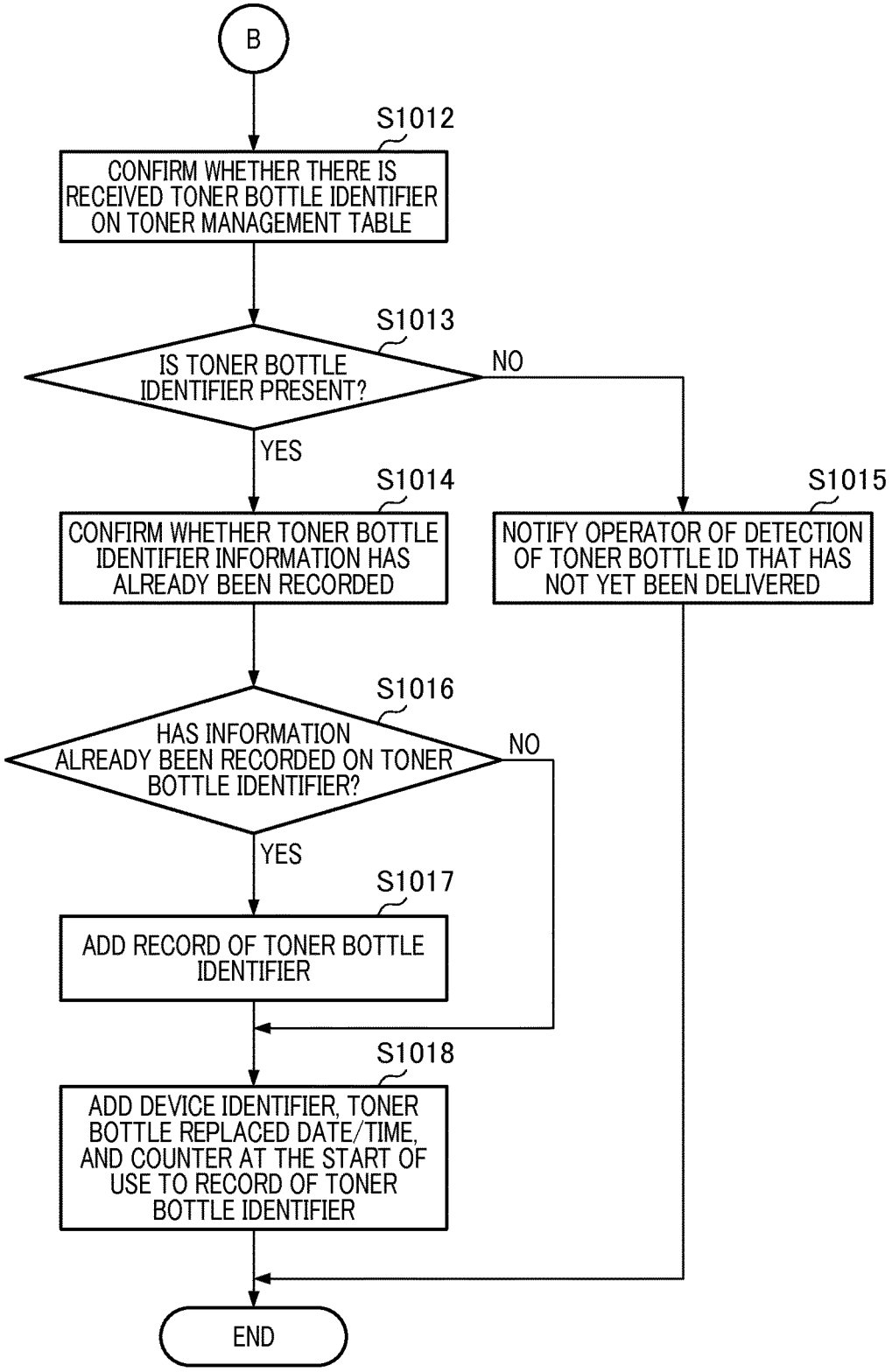
FIG. 12 illustrates processing for receiving an alarm and creating a management table by a management device.

The processes in steps S1012 to S1018 are shown in FIG. 12. In step S1012, the management information input/output unit 503 acquires the toner bottle ID 609 from the event information received from the image forming device 100. In step S1013, the management information input/output unit 503 confirms whether or not there is toner bottle identification information on delivered toner bottle identifier information on the toner management table. When the management information input/output unit 503 confirms that there is toner bottle identification information, the process advances to step S1014. When there is no toner bottle identification information, the process advances to step S1015.

In step S1014, the management information input/output unit 503 confirms whether or not the received toner bottle identification information has already been recorded on the toner management table. The reason for this is because, when the toner bottle was prematurely removed upon previous toner bottle removal, the record of interest has already been recorded. Here, the management information input/output unit 503 discovers a toner bottle ID of interest in the list of delivered bottle identifiers and confirms whether or not the record of the toner bottle ID has already been recorded. Then, the process advances to step S1016. In step S1015, the management information input/output unit 503 determines that the toner bottle ID of a toner bottle which has not been delivered to a customer is used by the customer. Thus, the management information input/output unit 503 notifies the operator of the device management system of the fact that an event which should not occur in toner management has occurred, and the process ends. With the aid of this notification, the operator of the device management system can grasp a false detection of a sensor provided in an image forming device, malfunction of an image forming device due to loading of unexpected toner bottle on the customer side, or the like at an early stage.

In step S1016, the management information input/output unit 503 determines whether or not the record of a toner bottle identifier included in the received event information representing toner bottle replacement has already been recorded. When the management information input/output unit 503 determines that the record has already been recorded, the process advances to step S1017. Also, when the management information input/output unit 503 determines that the record has not yet been recorded, the process advances to step S1018. In step S1017, the management information input/output unit 503 again issues the record of the same toner bottle ID to the delivered toner bottle identifier on the toner management table. Then, the process advances to step S1018. In step S1018, in the delivered toner bottle identification information on the toner management table, the management information input/output unit 503 additionally writes a device identifier and a bottle identifier on uninput record of a toner bottle ID described in the received alarm. Also, the management information input/output unit 503 additionally writes the toner bottle replaced date/time and the counter at the start of use on the uninput record, and the process ends. In other words, when the record of a toner bottle identifier included in the received event information has not yet been recorded, the management information input/output unit 503 stores the device identifier, the bottle identifier, and the counter at the start of use as management information corresponding to a newly loaded toner bottle.

(Second Embodiment)

<Example 2 of Communication Data of a Toner Replacement Notification Received by the Management Server>

Figure 13:
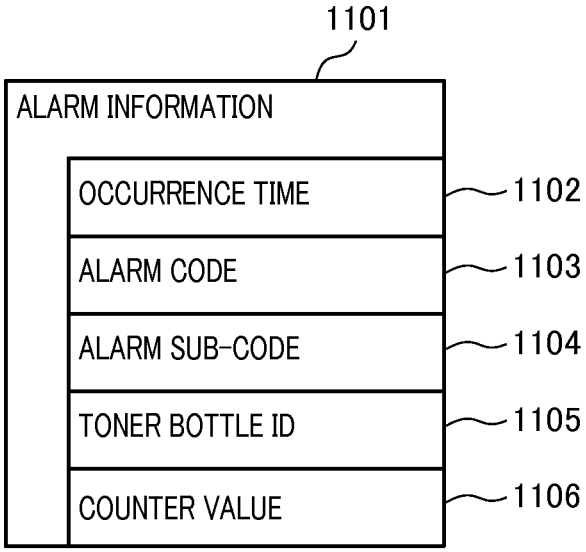
FIG. 13 illustrates an example of another alarm received by a management device.

FIG. 13 is a diagram illustrating communication data of a toner bottle replacement notification received from the image forming device 100 or the site monitoring device 101 to the management server 105. Basically, FIG. 13 is consistent with FIG. 6 but the device identification information 601 is not present in transmission data. A second embodiment shows that, even when a plurality of image forming devices is managed, the same management as that described in the first embodiment can be performed by changing a transmission timing or transmission data.

In the present invention, the management server 105 manages the following three types of information in order to perform toner management. In other words, the management server manages three types of information: 1. the total number of unused toner bottles that have already been delivered to a customer, 2. the total number of toner bottles that have already been delivered to a customer but have been prematurely removed without being completely used, and 3. the usage trend of each toner. A description will be given of another example of communication data for managing the above three types of information.

Alarm information 1101 is information representing the type of an event occurred in the image forming device 100. In the present embodiment, the alarm information 1101 is constituted by an occurrence time 1102, an alarm code 1103, an alarm sub-code 1104, a toner bottle ID 1105, and a counter value 1106. Of course, alarm information is not limited to the above information but another information may also be added to alarm information in accordance with the content of an alarm to be issued.

In the present embodiment, the alarm code 1103 represents the occurrence of a toner bottle replacement event in an image forming device. It should be noted that the removal of a toner bottle and the loading of a toner bottle are assigned to different alarm codes. Each event is defined as information to be transmitted. In other words, in contrast to the first embodiment, the image forming device 100 notifies the management server 105 of an event two times upon removal and loading of a toner bottle. The alarm sub-code 1104 represents relevant information relating to toner bottle replacement, such as information of the remaining amount of toner in a toner bottle upon removal of the toner bottle, color information of toner to be replaced, or the like by subcoding. The toner bottle ID 1105 represents the serial number of a toner bottle of interest upon removal or loading of the same. Also, the counter value 1106 represents a counter value upon removal or loading of a toner bottle.

Example 2-1 of Operation Performed by the Image Forming Device>

Figure 14:
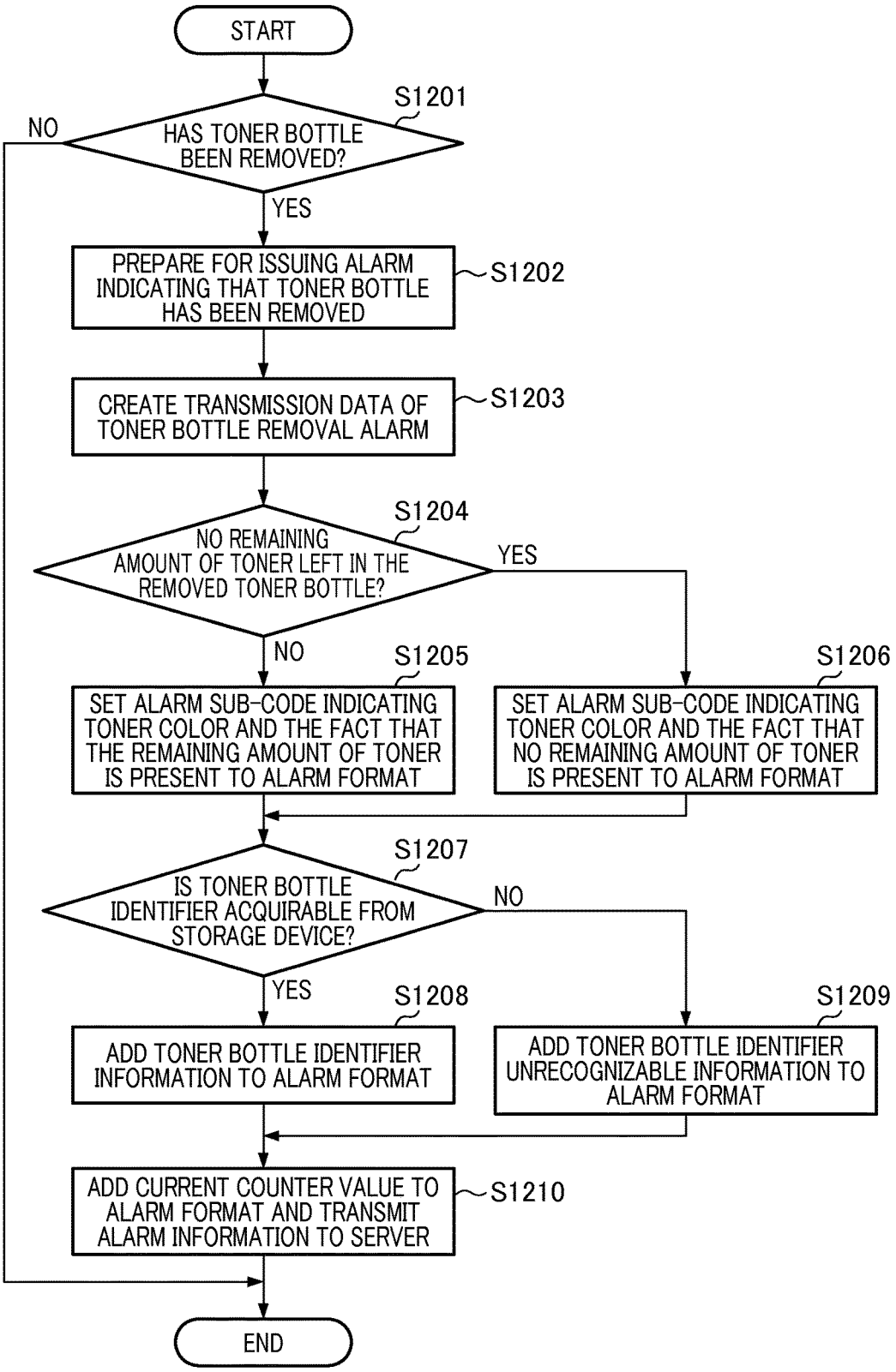
FIG. 14 illustrates processing performed by a management device that has received a toner bottle removal notification.

A description will be given of an exemplary operation performed by the image forming device 100 of the present embodiment according to the second embodiment. FIG. 14 is a flowchart illustrating processing from the start of toner bottle replacement by a user of the image forming device 100 up to the transmission of a toner bottle removal notification from the image forming device 100 to the management server 105 after completion of toner bottle removal. The processing in the flowchart is realized by expanding a program stored in either the ROM 204 or the storage device 206 shown in FIG. 2 on the RAM 205 and by executing the program by the CPU 207 as appropriate. Also, the processing in the flowchart is processing performed by the event management manager 302, the storage device 305, and the monitor information transmission manager 306 shown in FIG. 3.

When the user of the image forming device 100 opens the door of the image forming device in order to replace a toner bottle, the bottle replacement detection unit 313 of the image forming device 100 notifies the device interface 301 of toner bottle replacement event information. In step S1201, the event management manager 302 determines whether or not the toner bottle has been removed from the image forming device 100.

In step S1201, when the event management manager 302 determines that the toner bottle has been removed, the monitoring control unit 304 prepares for issuing an alarm indicating that the toner bottle has been removed from the event unit 303 in step S1202. Then, the monitoring control unit 304 advances the process to step S1203. In step S1203, the request reception unit 307 receives an event transmission request from the monitoring control unit 304 and immediately passes the event transmission request to the transmission information management unit 308. When the transmission information management unit 308 receives the request, the transmission information management unit 308 starts to create transmission data of a toner bottle removal alarm. Then, the process advances to step S1204. In step S1204, the information reference unit 309 confirms the remaining amount of toner left in the removed toner bottle by means of the storage device 305 by receiving the request from the transmission information management unit 308. When the remaining amount of toner is present, the transmission information management unit 308 advances the process to step S1205. Also, when no remaining amount of toner is present, the transmission information management unit 308 advances the process to step S1206.

In step S1205, the transmission information management unit 308 sets an alarm sub-code indicating information of the color of toner in the toner bottle that has been removed in this time and information indicating that the remaining amount of toner is present to an alarm format, and the process advances to step S1207. In step S1206, the transmission information management unit 308 sets an alarm sub-code indicating information of the color of toner in the toner bottle that has been removed in this time and information indicating that no remaining amount of toner is present to an alarm format, and the process advances to step S1207.

In step S1207, the information reference unit 309 acquires identification information of the toner bottle that has been removed in this time from the storage device 305 by receiving the request from the transmission information management unit 308. When toner bottle identification information can be acquired, the transmission information management unit 308 advances the process to step S1208. Also, when toner bottle identification information cannot be acquired and thus cannot be recognized, the transmission information management unit 308 advances the process to step S1209.

In step S1208, the transmission information management unit 308 sets the serial number of the toner bottle as toner bottle identification information to the alarm format, and the process advances to step S1210. In step S1209, the transmission information management unit 308 sets information indicating that the toner bottle cannot be recognized to the alarm format, and the process advances to step S1210. In step S1210, the transmission information management unit 308 sets the counter value of the current image forming device to the alarm format and transmits alarm information to the management server 105. Then, processing of notification information indicating that the toner bottle has been removed in this time ends.

<Example 2-2 of Operation Performed by the Image Forming Device>

Figure 15:
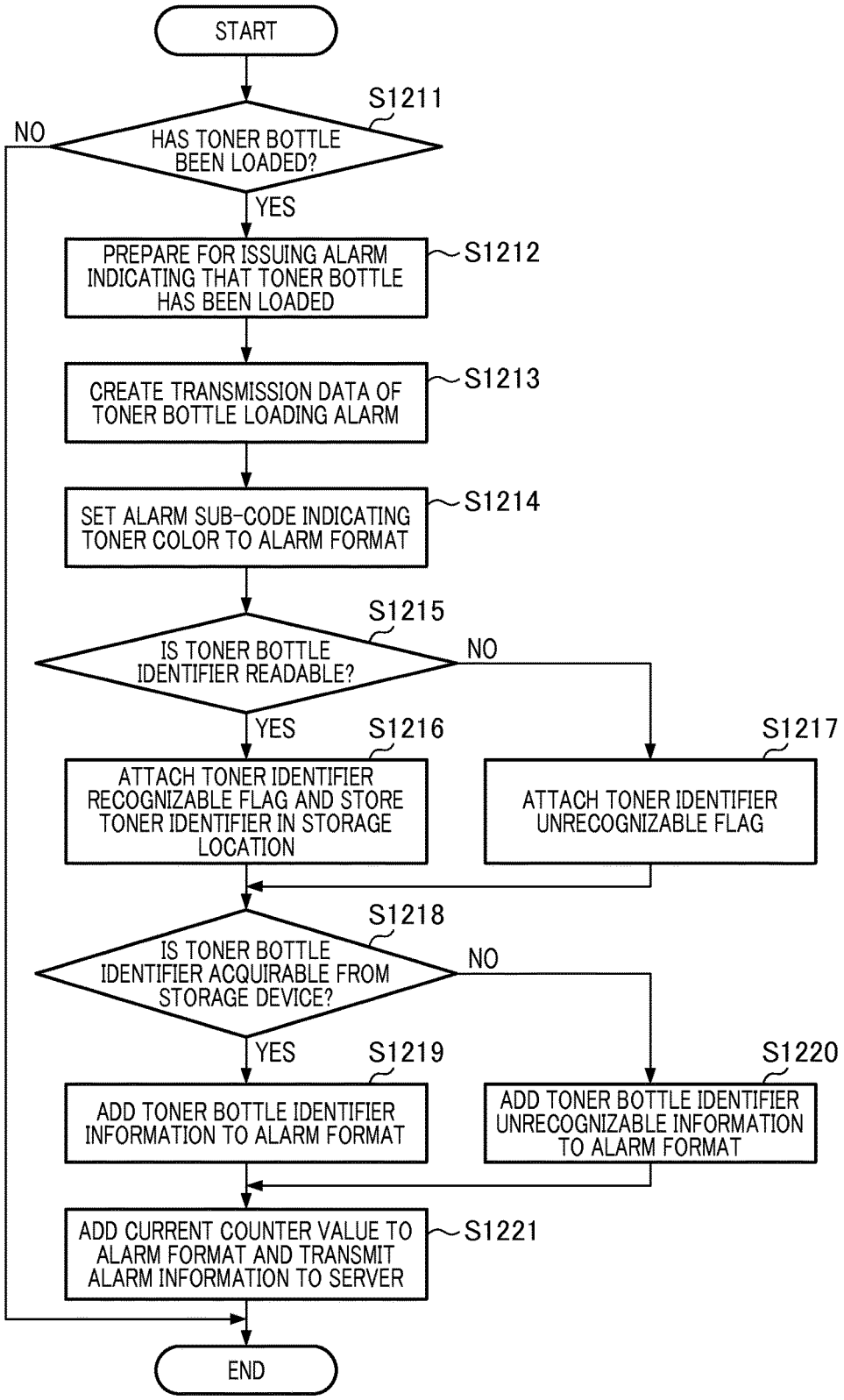
FIG. 15 illustrates processing performed by a management device that has received a toner bottle loading notification.

A description will be given of an exemplary operation performed by the image forming device 100 according to the second embodiment. FIG. 15 is a flowchart illustrating processing from the start of loading of the toner bottle by the user of the image forming device 100 up to the transmission of a toner bottle loading notification from the image forming device 100 to the management server 105. The processing in the flowchart is realized by expanding a program stored in either the ROM 204 or the storage device 206 shown in FIG. 2 on the RAM 205 and by executing the program by the CPU 207 as appropriate. Also, the processing in the flowchart is processing performed by the event management manager 302, the storage device 305, and the monitor information transmission manager 306 shown in FIG. 3.

When the user of the image forming device 100 loads a toner bottle into the image forming device 100, the bottle replacement detection unit 313 of the image forming device 100 detects the fact that the toner bottle has been loaded and notifies the device interface 301 of the detected event information. In step S1211, the event management manager 302 determines whether or not the toner bottle has been loaded. When the event management manager 302 determines in step S1211 that the toner bottle has been loaded, the monitoring control unit 304 prepares for issuing an alarm indicating that the toner bottle has been loaded in step S1212. Then, the process advances to step S1213.

In step S1213, the request reception unit 307 receives a transmission request for an event representing the fact that the toner bottle has been loaded from the monitoring control unit 304. The request reception unit 307 transmits the transmission request to the transmission information management unit 308, and the transmission information management unit 308 starts to create transmission data of a toner bottle loading alarm. Then, the process advances to step S1214.

In step S1214, the information reference unit 309 sets an alarm sub-code indicating the color of the loaded toner bottle to the alarm format by receiving the request from the transmission information management unit 308, and the process advances to step S1215. In step S1215, the information reference unit 309 determines whether or not the serial number of the loaded toner bottle is readable by receiving the request from the transmission information management unit 308. Here, when the serial number of the toner bottle is readable, the process advances to step S1216. When the serial number of the toner bottle is unreadable, the process advances to step S1217.

In step S1216, the bottle identification information detection unit 311 notifies the device interface 301 of the serial number of the loaded toner bottle. The monitoring control unit 304 receives the serial number of the loaded toner bottle via the event unit 303 and stores the serial number of the loaded toner bottle as toner bottle identification information in the storage device 305. Then, the process advances to step S1218. In step S1217, the monitoring control unit 304 stores information indicating that toner bottle identification information cannot be recognized in the storage device 305, and the process advances to step S1218.

In step S1218, the information reference unit 309 determines whether or not toner bottle identification information can be read out from the storage device 305 by receiving the request from the transmission information management unit 308. When identification information of the loaded toner bottle can be acquired, the information reference unit 309 advances the process to step S1219. Also, when toner bottle identification information cannot be acquired, the information reference unit 309 advances the process to step S1220.

In step S1219, the transmission information management unit 308 sets the toner bottle identification information acquired from the storage device 305 to the alarm format to be transmitted. Then, the process advances to step S1221. In step S1220, the transmission information management unit 308 sets information indicating that toner bottle identification information could not be acquired to the alarm format. Then, the process advances to step S1221. In step S1221, the transmission information management unit 308 sets the counter value of the current image forming device to the event information format and transmits alarm information to the management server 105. Then, processing of notification information indicating that the toner bottle has been loaded ends.

<Example of an Alarm History Received by the Management Server 105>

FIG. 16A is a diagram illustrating an alarm reception history received from a plurality of the image forming devices 100 or the site monitoring device 101 for managing a plurality of the image forming devices 100 to the management server 105. The alarm reception history is constituted by number, alarm, bottle identifier, toner bottle replaced date/time, counter upon alarm transmission, and bottle remaining amount state upon removal. The alarm number defines the sequential order of alarms received. Either "toner bottle loading" or "toner bottle removal" is filled in the alarm. The bottle identifier is the serial number of a toner bottle that is loaded or removed. The toner bottle replaced date/time is a date/time at which an alarm is received. The counter upon alarm transmission is a counter value obtained when an alarm is received. Either "premature removal" or "empty" is filled in the bottle remaining amount state upon removal. In the case of a toner bottle loading alarm, "N/A" indicating not applicable is filled in the bottle remaining amount state upon removal.

<Example 2 of a Toner Management Table in the Management Server 105>

FIG. 16B is a diagram illustrating the state in DB for managing management information when the management server 105 receives the toner bottle loading/removal notification shown in FIG. 16A. The toner management table representing the state in DB schematically represents the structure of information and the information described in FIG. 16B is relational database in practice and is constituted by a plurality of tables.

The toner management table shown in FIG. 16B includes fields storing delivered bottle identifier, alarm-received bottle identifier, counter value at the start of use, counter value at the end of use, actual usage counter, and bottle remaining amount state upon removal. The delivered bottle identifier is a field for storing the identifier of a toner bottle sent to a customer by a sales company. The delivered bottle identifier is a field in which a serial number is stored when the toner delivery personnel of the sales company writes down the serial number of each toner bottle upon sending toner bottles to a customer and inputs the serial number to a system.

The alarm-received bottle identifier on the toner management table is the identifier of a toner bottle when toner bottle loading or toner bottle removal is performed on the image forming device for maintenance. When received a toner bottle replacement alarm, the management information input/output unit 503 additionally writes the bottle identifier on the same record on the toner management table with reference to the same ID as the alarm-received bottle identifier included in the toner bottle replacement alarm from the delivered bottle ID.

The counter at the start of use on the toner management table is the counter value in an image forming device when a newly loaded toner bottle has been started for use upon loading the toner bottle into the image forming device for maintenance. When the management information input/output unit 503 receives a toner bottle loading notification, the management information input/output unit 503 additionally writes the counter value at the start of use on the record of the delivered bottle ID having the same serial number on the toner management table.

The counter at the end of use on the toner management table is the counter value in an image forming device when a toner bottle has been ended for use upon toner bottle removal from the image forming device for maintenance. When the management information input/output unit 503 receives a toner bottle removal notification, the management information input/output unit 503 additionally writes the counter value at the end of use on the record of the delivered bottle ID having the same serial number on the toner management table.

The actual usage counter on the toner management table is a counter value representing the number of copies used from the loading of a toner bottle of interest in the image forming device to the removal thereof from the same. The counter value is obtained by calculating the difference between the counter at the end of use and the counter at the start of use by the management information input/output unit 503.

The bottle remaining amount state upon removal on the toner management table is the remaining amount state of toner in a toner bottle when toner bottle removal is performed on an image forming device for maintenance. In other words, the bottle remaining amount state upon removal is a value indicating either the fact that there is a remaining amount of toner left in the removed toner bottle and thus the toner bottle has been prematurely removed or the fact that there is no remaining amount of toner left in the removed toner bottle and thus the emptied toner bottle has been removed. When received a toner bottle removal alarm, the management information input/output unit 503 acquires the remaining amount state of toner in a toner bottle with reference to a subcode in the alarm and additionally writes appropriate data on the toner management table.

The management information input/output unit 503 acquires the toner bottle ID 1105 serving as toner bottle identification information and the counter value 1106 shown in FIG. 13 from the toner bottle loading notification. Then, the management information input/output unit 503 searches the toner bottle ID of a toner bottle newly loaded in an image forming device from the list of delivered bottle identifiers on the toner management table. When the toner bottle ID 1105 matches the searched toner bottle ID, the management information input/output unit 503 additionally writes the received device identifier and bottle identifier and the counter at the start of use on the same record. When the toner bottle ID 1105 matches the searched toner bottle ID but the toner bottle is provided with a previously-used history and the remaining amount state of toner in a toner bottle prior to replacement is premature removal, a new record is created and the same information is additionally written on the new record. In this manner, even when "premature removal" is filled in the bottle remaining amount state upon removal but the removed toner bottle is again loaded into the image forming device and has been completely used, the management server 105 can perform appropriate information management.

The management information input/output unit 503 acquires the alarm sub-code 1104, the toner bottle ID 1105 serving as toner bottle identification information, and the counter value 1106 shown in FIG. 13 from a toner bottle removal notification. Then, the management information input/output unit 503 searches the removed toner bottle ID from the list of delivered bottle identifiers on the toner management table. When the toner bottle ID 1105 matches the searched toner bottle ID, the management information input/output unit 503 additionally writes the counter at the end of use, the bottle remaining amount state upon removal, and the calculated actual usage counter on the same record.

With the aid of the above management, the management information input/output unit 503 can confirm the following three types of information from the toner management table. In other words, the management information input/output unit 503 can confirm three types of information: 1. the total number of unused toner bottles that have already been delivered to a customer, 2. the total number of toner bottles that have already been delivered to a customer but have been prematurely removed without being completely used, 3. the usage trend of each toner bottle.

<Example 2 of Operation Performed by the Management Server>

Figure 17:
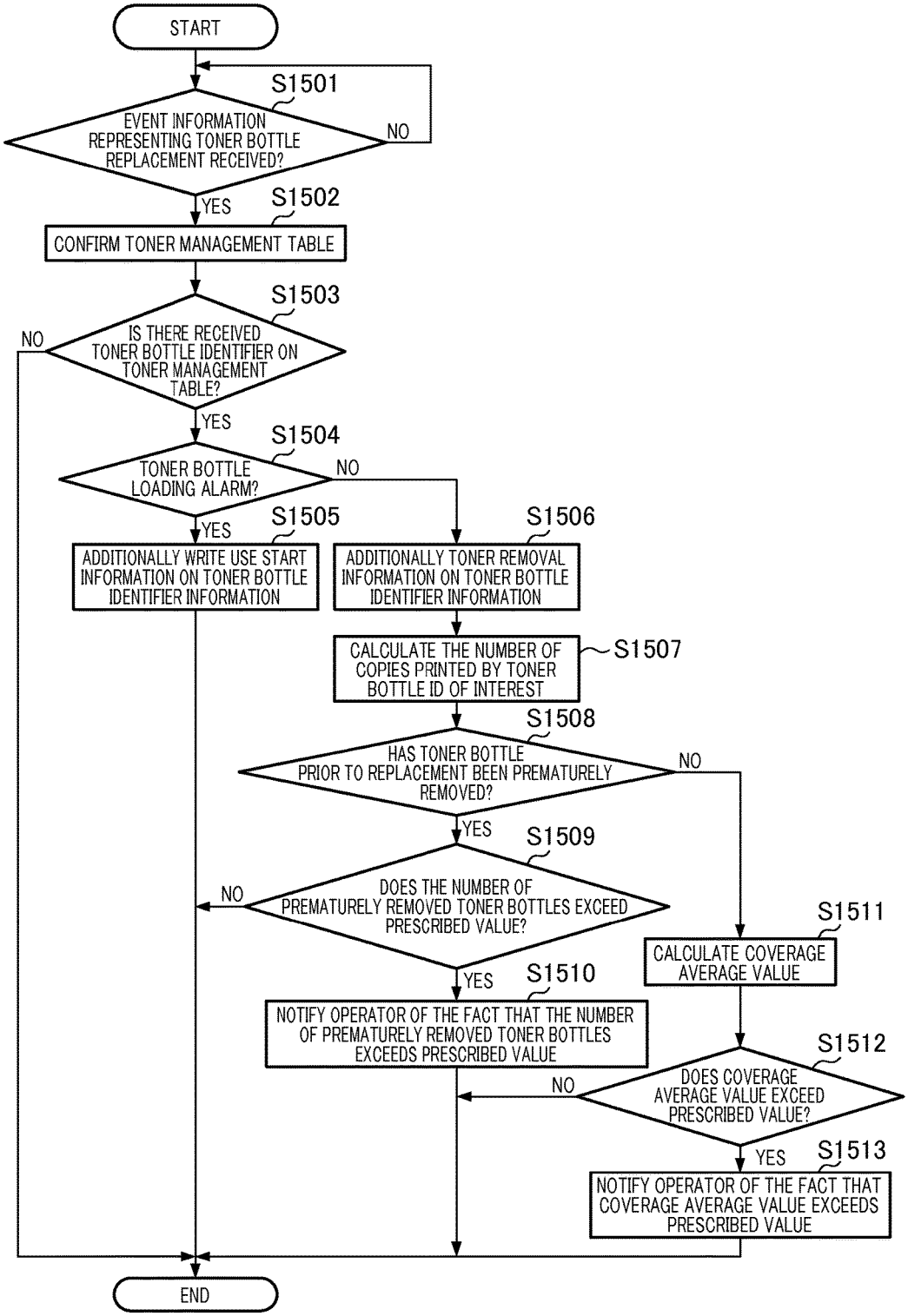
FIG. 17 illustrates processing for receiving an alarm and creating a management table by a management device.

A description will be given of Example 2 of operation performed by the management server 105 of the present embodiment based on the above configuration. FIG. 17 is a flowchart illustrating processing from the reception of a toner bottle loading and removal notification by the device management system up to the provision of a mail notification for prompting a user to confirm a use method when the management server 105 updates the toner management table. The processing in the flowchart is realized by expanding a program stored in either the ROM 403 or the storage device 408 shown in FIG. 4 on the RAM 404 and by executing the program by the CPU 402 as appropriate. Also, the processing in the flowchart is processing performed by the event information reception unit 502, the management information input/output unit 503, the management information storage unit 504, the premature removal number determination unit 505, the coverage average determination unit 506, and the mail notification unit 507 shown in FIG. 5.

When a toner bottle replacement notification is transmitted from the image forming device 100 and the management server 105 receives data via the Web Service I/F 501, toner bottle replacement notification reception processing starts in step S1501. In step S1501, the event information reception unit 502 receives a toner bottle replacement notification alarm. Then, the process advances to step S1502.

In step S1502, the management information input/output unit 503 reads out the toner management table from the management information storage unit 504 and confirms information in the table. Then, the process advances to step S1503. In step S1503, the management information input/output unit 503 confirms whether or not there is a record of the toner bottle identification information received by the alarm in the list of delivered bottle identifiers on the toner management table. Here, when there is a record of a toner bottle ID, the process advances to step S1504. When there is no record of a toner bottle ID, the process ends.

In step S1504, the management information input/output unit 503 determines whether the type of the received alarm is either a toner bottle loading alarm or a toner bottle removal alarm. Here, when the type of the received alarm is a toner bottle loading alarm, the process advances to step S1505. When the type of the received alarm is a toner bottle removal alarm, the process advances to step S1506. In step S1505, the management information input/output unit 503 additionally writes a counter at the start of use on a record of a toner bottle ID of interest in the list of delivered bottle identifiers on the toner management table. Then, the process ends.

In step S1506, the management information input/output unit 503 additionally writes a counter at the end of use and a bottle remaining amount state upon removal on a record of a toner bottle ID of interest in the list of delivered bottle identifiers on the toner management table. Then, the process advances to step S1507. In step S1507, the management information input/output unit 503 calculates an actual usage counter from the difference between the counter at the start of use and the counter at the end of use on the record of the additionally-written toner bottle ID to thereby update the record of the toner bottle ID of interest. Then, the process advances to step S1508.

In step S1508, the management information input/output unit 503 confirms the bottle remaining amount state upon removal additionally written in step S1506. When the remaining amount of toner is present upon removal thereof, the process advances to step S1509. When no remaining amount of toner is present upon removal thereof, the process advances to step S1511. In step S1509, the premature removal number determination unit 505 confirms information of the past toner bottles from the toner management table and confirms whether or not the number of prematurely removed toner bottles exceeds a prescribed value. When the number of prematurely removed toner bottles exceeds a prescribed value, the process advances to step S1510. When the number of prematurely removed toner bottles does not exceed a prescribed value, the process ends.

In step S1510, the mail notification unit 507 notifies the user of the image forming device of a mail with content as shown in FIG. 18 indicating that the number of prematurely removed toner bottles exceeds a prescribed value. Then, the process ends. In step S1511, the coverage average determination unit 506 confirms information of the past toner bottles from the toner management table and calculates coverage representing the printing density of each toner bottle from the number of copies printed by each used-up toner bottle to thereby determine an average value. Then, the process advances to step S1512.

In step S1512, when the average value of coverage representing printing density exceeds a prescribed value, the coverage average determination unit 506 advances the process to step S1513. When the average value of coverage representing printing density does not exceed a prescribed value, the process ends. In step S1513, the mail notification unit 507 notifies the user of the image forming device of a mail with content as shown in FIG. 19 indicating that the average value of coverage representing printing density exceeds a prescribed value. Then, the process ends. With the aid of the above processing, even when a plurality of image forming devices is managed, the plurality of image forming devices can be managed appropriately by changing a transmission timing or transmission data without adding device identification information to alarm information.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-160296 filed on Jul. 19, 2012, which is hereby incorporated by reference herein in its entirety.

What is claimed is:

1. An image forming device in which a consumable container is replaceably loaded, the image forming device comprising:

a memory;

a processor that can communicate with the memory;

a network unit configured to control a communication via a network, and a detector that detects identification information of the consumable container loaded in the image forming device, wherein the memory stores a program which, when executed by the processor, causes the image forming device to:

manage remaining amount information of a consumable contained in a loaded consumable container, transmit, in response to a detection of identification information of a new consumable container loaded in the image forming device by the detector, a first replacement notification to a management device which manages the image forming device via the network unit, wherein transmission data as the first replacement notification includes a main code indicating a load of the new consumable container, a sub-code according to remaining amount information of the consumable contained in another consumable container which had been removed before the detection by the detector, the detected identification information of the new consumable container, and counter information corresponding to a value accumulated by the image forming device for each print processing, and transmit, when identification information of a new consumable container loaded in the image forming device is not detected by the detector, a second replacement notification to the management device, wherein transmission data as the second replacement notification includes the main code, the sub-code, the counter information and information indicating that the new consumable container has not been identified.

2. The image forming device according to claim 1, wherein the first replacement notification further includes identification information of the image forming device, and wherein the management device is configured to associate identification information of the image forming device, identification information of the newly loaded consumable container, and counter information at the start of using a consumable container which has been newly loaded with each other based on the first replacement notification transmitted by the transmission unit and then store the associated information as management information.

3. The image forming device according to claim 1, wherein the sub-code is information indicating whether or not the consumable is empty.

4. The image forming device according to claim 1, wherein the consumable is toner or ink.

5. The image forming device according to claim 1, wherein the program which, when executed by the processor, further causes the image forming device to transmit a notification indicating low status of a remaining amount of the consumable contained in a consumable container loaded in the image forming device to the management device via the network unit.

6. A control method in an image forming device comprising a network unit configured to control a communication via a network, and a detector that detects identification information of a consumable container loaded in the image forming device, the control method comprising:

managing remaining amount information of a consumable contained in the loaded consumable container;

transmitting, in response to a detection of identification information of a new consumable container loaded in the image forming device by the detector, a first replacement notification to a management device which manages the image forming device via the network unit, wherein transmission data as the first replacement notification includes a main code indicating a load of the new consumable container, a sub-code according to remaining amount information of the consumable contained in another consumable container which had been removed before the detection by the detector, the detected identification information of the new consumable container, and counter information corresponding to a value accumulated by the image forming device for each print processing, and transmitting, when identification information of a new consumable container loaded in the image forming device is not detected by the detector, a second replacement notification to the management device, wherein transmission data as the second replacement notification includes the main code, the sub-code, the counter information and information indicating that the new consumable container has not been identified.

7. The control method according to claim 6, wherein the first replacement notification further includes identification information of the image forming device, and wherein the management device is configured to associate identification information of the image forming device, identification information of the newly loaded consumable container, and counter information at the start of using a consumable container which has been newly loaded with each other based on the first replacement notification transmitted in the transmitting and then store the associated information as management information.

8. The control method according to claim 6, wherein the sub-code is information indicating whether or not the consumable is empty.

9. The control method according to claim 6, wherein the consumable is toner or ink.

10. A non-transitory storage medium storing a readable program for causing a computer to execute a controlling method executed in an image forming device comprising a network unit configured to control a communication via a network, and a detector that detects identification information of a consumable container loaded in the image forming device, the control method comprising:

managing remaining amount information of a consumable contained in the loaded consumable container;

transmitting, in response to a detection of identification information of a new consumable container loaded in the image forming device by the detector, a first replacement notification to a management device which manages the image forming device via the network unit, wherein transmission data as the first replacement notification includes a main code indicating a load of the new consumable container, a sub-code according to remaining amount information of the consumable contained in another consumable container which had been removed before the detection by the detector, the detected identification information of the new consumable container, and counter information corresponding to a value accumulated by the image forming device for each print processing, and transmitting, when identification information of a new consumable container loaded in the image forming device is not detected by the detector, a second replacement notification to the management device, wherein transmission data as the second replacement notification includes the main code, the sub-code, the counter information and information indicating that the new consumable container has not been identified.

11. The non-transitory storage medium according to claim 10, wherein the first replacement notification further includes identification information of the image forming device, and wherein the management device is configured to associate identification information of the image forming device, identification information of the newly loaded consumable container, and counter information at the start of using a consumable container which has been newly loaded with each other based on the first replacement notification transmitted in the transmitting and then store the associated information as management information.

12. The non-transitory storage medium according to claim 10, wherein the sub-code is information indicating whether or not the consumable is empty.

13. The non-transitory storage medium according to claim 10, wherein the consumable is toner or ink.

14. A management system comprising:

an image forming device that a consumable container is replaceably loaded; and a management device that communicates with the image forming device via a network, wherein the image forming device comprises:

a memory;

a processor that can communicate with the memory;

a network unit configured to control a communication via the network, and a detector that detects identification information of a consumable container loaded in the image forming device, wherein the memory stores a program which, when executed by the processor, causes the image forming device to:

manage remaining amount information of a consumable contained in the loaded consumable container, transmit, in response to a detection of identification information of a new consumable container loaded in the image forming device by the detector, a first replacement notification to the management device via the network unit, wherein transmission data as the first replacement notification includes a main code indicating a load of the new consumable container, a sub-code according to remaining amount information of the consumable contained in another consumable container which had been removed before the detection by the detector, the detected identification information of the new consumable container, and counter information corresponding to a value accumulated by the image forming device for each print processing, and transmit, when identification information of a new consumable container loaded in the image forming device is not detected by the detector, a second replacement notification to the management device, wherein transmission data as the second replacement notification includes the main code, the sub-code, the counter information and information indicating that the new consumable container has not been identified, wherein the management device comprises:

a reception unit configured to receive the first replacement notification or the second replacement notification from the image forming device; and a storage unit configured to store the identification information, the counter information and the remaining amount information as management information based on the received first replacement notification.

15. The management system according to claim 14, wherein the sub-code is information indicating whether or not the consumable is empty.

16. The management system according to claim 14, wherein the consumable is toner or ink.

17. A control method for a management system comprising:

an image forming device that a consumable container is replaceably loaded; and a management device that communicates with the image forming device via a network, wherein the image forming device comprises a network unit configured to control a communication via the network, and a detector that detects identification information of a consumable container loaded in the image forming device, wherein the control method comprises:

managing, in the image forming device, remaining amount information of a consumable contained in a loaded consumable container, transmitting, by the image forming device, a first replacement notification to the management device via the network unit in response to a detection of identification information of a new consumable container loaded in the image forming device by the detector, wherein transmission data as the first replacement notification includes a main code indicating a load of the new consumable container, a sub-code according to remaining amount information of the consumable contained in another consumable container which had been removed before the detection by the detector, the detected identification information of the new consumable container, and counter information corresponding to a value accumulated by the image forming device for each print processing, transmitting, when identification information of a new consumable container loaded in the image forming device is not detected by the detector, a second replacement notification to the management device, wherein transmission data as the second replacement notification includes the main code, the sub-code, the counter information and information indicating that the new consumable container has not been identified, receiving, by the management device, the first replacement notification or the second replacement notification from the image forming device, and storing, by the management device, the identification information, the counter information and the remaining amount information as management information based on the received first replacement notification.

* * * * *